US007641309B2

(12) United States Patent
Teshigawara et al.

(10) Patent No.: US 7,641,309 B2
(45) Date of Patent: Jan. 5, 2010

(54) DATA PROCESSING APPARATUS, DATA PROCESSING METHOD, INK JET PRINTING APPARATUS, AND INK JET PRINTING METHOD

(75) Inventors: Minoru Teshigawara, Yokohama (JP); Naoji Otsuka, Yokohama (JP); Kiichiro Takahashi, Kawasaki (JP); Osamu Iwasaki, Tokyo (JP); Tetsuya Edamura, Kawasaki (JP); Yoshinori Nakagawa, Kawasaki (JP); Satoshi Seki, Kawasaki (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/204,008

(22) Filed: Aug. 16, 2005

(65) Prior Publication Data

US 2006/0038850 A1 Feb. 23, 2006

(30) Foreign Application Priority Data

Aug. 18, 2004 (JP) ..... 2004-238888

(51) Int. Cl.
*B41J 2/21* (2006.01)

(52) U.S. Cl. ..... 347/43; 347/40; 347/41; 347/12

(58) Field of Classification Search ..... 347/15, 347/43, 40, 12, 41, 13; 358/1.2, 1.9
See application file for complete search history.

(56) References Cited

U.S. PATENT DOCUMENTS 6,010,208 A * 1/2000 Powers et al. ..... 347/65
6,102,511 A 8/2000 Shioya et al. ..... 347/9
6,142,598 A 11/2000 Iwasaki et al. ..... 347/9
6,203,133 B1 3/2001 Tanaka et al. ..... 347/15
6,454,390 B1 9/2002 Takahashi et al. ..... 347/41
6,474,767 B1 11/2002 Teshigawara et al. ..... 347/19
6,592,203 B1 * 7/2003 Bates et al. ..... 347/40
6,601,939 B2 8/2003 Fujita et al. ..... 347/15
6,669,331 B2 * 12/2003 Teshigawara et al. ..... 347/43
6,729,710 B2 5/2004 Chikuma et al. ..... 347/14
6,874,864 B1 4/2005 Maeda et al. ..... 347/41
6,877,833 B2 * 4/2005 Teshigawara et al. ..... 347/15
7,077,500 B2 * 7/2006 Yabe ..... 347/40

(Continued)

FOREIGN PATENT DOCUMENTS

JP 9-46522 2/1997

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

A present invention reduces the generation of periodic uneven print density in the image in a main scanning direction. The present invention focuses attention on a fact that, when a printing head including a plurality of nozzle arrays for ejecting different inks is used to print an image and when the same pixel is printed by a combination of nozzle arrays in which an interval in the main scanning direction is relatively short, the displacement of ink impact positions is smaller when compared to a case where the same pixel is printed by a combination of nozzle arrays in which an interval in the main scanning direction is relatively long. Thus, a dot arrangement pattern allocated to the pixel data is selected so that the same pixel is printed by a combination of nozzle arrays in which an interval in the main scanning direction is relatively short.

3 Claims, 16 Drawing Sheets

U.S. PATENT DOCUMENTS

2002/0060717 A1* 5/2002 Weijkamp ..... 347/43
2002/0186276 A1* 12/2002 Nakagawa ..... 347/43
2003/0214551 A1* 11/2003 Yabe ..... 347/40
2003/0214555 A1* 11/2003 Teshigawara et al. ..... 347/43
2004/0021731 A1* 2/2004 Yabe et al. ..... 347/40
2004/0090480 A1* 5/2004 Teshikawara et al. ..... 347/15
2004/0252160 A1* 12/2004 Iwasaki et al. ..... 347/41
2005/0018012 A1* 1/2005 Iwasaki et al. ..... 347/43

* cited by examiner

DISPLACEMENT OF INK IMPACT POSITION
IN SUB SCANNING DIRECTION: 5μm

DISPLACEMENT OF INK IMPACT POSITION
IN SUB SCANNING DIRECTION: 10μm

DISPLACEMENT OF INK IMPACT POSITION
IN SUB SCANNING DIRECTION: 5μm

DISPLACEMENT OF INK IMPACT POSITION
IN SUB SCANNING DIRECTION: 10μm

RELATION BETWEEN NOZZLE ARRAY FOR SMALL CYAN (SC1) AND NOZZLE ARRAY FOR SMALL MAGENTA (SM1)

RELATION BETWEEN NOZZLE ARRAY FOR SMALL CYAN (SC1) AND NOZZLE ARRAY FOR SMALL MAGENTA (SM2)

RELATION BETWEEN NOZZLE ARRAY FOR SMALL CYAN (SC1) AND NOZZLE ARRAY FOR SMALL CYAN (SC2)

DATA PROCESSING APPARATUS, DATA PROCESSING METHOD, INK JET PRINTING APPARATUS, AND INK JET PRINTING METHOD

BACKGROUND OF THE INVENTION

1. Field of the Invention

The present invention relates to a data processing apparatus, a data processing method, an ink jet printing apparatus, and an ink jet printing method that are related to a printing method using a dot arrangement pattern. In particular, the present invention relates to a data processing apparatus, a data processing method, an ink jet printing apparatus, and an ink jet printing method for performing, when a plurality of types of inks are used for a printing, the printing so that quantized data (n value) that is n-valued (n=3) is developed, with regards to different ink, to provide a dot arrangement pattern having L (width)×M (length).

2. Description of the Related Art

With regards to an ink jet printing apparatus, efforts have been made recently to print an image having a higher quality by providing a printing droplet (ink droplet) having a smaller size. On the other hand, suggestions have been made to realize a high-speed processing of image data.

Japanese Patent Application Laid-open No. 9-46522 suggests a conversion processing method for converting inputted image data such that each of a plurality of printing colors is converted independently. The term "conversion processing" in this case intends to mean a quantized processing for a relatively low resolution and multiple values by a host apparatus. Image data subjected to this conversion processing is transferred to an ink jet printing apparatus. The printing apparatus converts the received image data that has a low resolution and that is highly quantized into a predetermined dot arrangement pattern to perform a printing based on this dot arrangement pattern (so-called dot matrix printing).

The printing method using a dot arrangement pattern as described above has involved some suggestions. For example, a plurality of dot arrangement patterns having different dot arrangements are previously prepared with regards to input image data having the same signal level (same tone level) so that a dot arrangement pattern selected from the plurality of dot arrangement patterns is allocated to the image data. In this case, with regards to a method for selecting a dot arrangement pattern to be allocated, some methods have been suggested, including a method for selecting a dot arrangement pattern depending on the position of the pixel data, a method for selecting a dot arrangement pattern based on a random number value consisting of a predetermined bit number, and a method for sequentially switching a to-be-used dot arrangement pattern depending on the existence or nonexistence of image data in a pixel array.

However, the printing of dot matrix as described above has a risk of causing a defect as described below.

In the case where a serial scan type ink jet printing apparatus is used to print an image for example, when image data having the same tone level continues, a risk causing periodic density fluctuation on a printing image in the main scanning direction may be caused while a carriage including a printing head is moved. This is presumably caused, for example, by an accuracy with which the printing head is attached to the carriage, the ink impact accuracy, and an error of the carriage feeding accuracy in the printing apparatus body.

In the case of a printing head in which a plurality of printing element arrays (nozzle arrays) are arranged in parallel in the main scanning direction (printing head having a so-called lateral arrangement) and in which one printing color (ink color) is associated with a plurality of printing element arrays, there may be a case in which the distance between printing element arrays may be different depending on each associated printing color. In this case, due to the carriage feeding accuracy in the main scanning direction for example, the level of displacement of the ink impact positions is different among printed colors, causing a risk in which periodic density fluctuation in the main scanning direction may be more remarkable. The density fluctuation described above has a close relation with a dot coverage rate per a pixel (unit pixel) (so-called area factor). Specifically, in the case where dots having different colors are arranged in a single pixel, when periodic displacement of ink impact position is caused in the sub scanning direction crossing the main scanning direction, the level of interference among dots for different colors is changed. Thus, some regions include a relatively large change of a so-called area factor while other regions include a relatively small change of a so-called area factor. This causes a periodic color displacement in the main scanning direction, causing density fluctuation to human eyes.

SUMMARY OF THE INVENTION

It is an objective of the present invention to provide a data processing apparatus, a data processing method, an ink jet printing apparatus, and an ink jet printing method for performing, when a plurality of types of inks are used for a printing of an image, the printing so that periodic density fluctuation in the main scanning direction in a printed image is suppressed from being caused so that the image can be printed with a high quality.

In a first aspect of the present invention, there is provided a data processing apparatus for selecting a dot arrangement pattern corresponding to a quantization level of pixel data quantized to have an n value (n=3) in order to form ink dots on a printing medium by using a printing head while scanning the printing head in a main scanning direction, the printing head including at least a plurality of first nozzle arrays and a plurality of second nozzle arrays, the plurality of first nozzle arrays being able to form first ink dots and being arranged at an interval in the main scanning direction, the plurality of second nozzle arrays being able to form second ink dots different from the first ink dots in at least the color or size and being arranged at an interval in the main scanning direction, the apparatus comprising:

selection means for selecting, for each of the first and second nozzle arrays, any one from a plurality of different dot arrangement patterns corresponding to the individual quantization level depending on the quantization levels of the pixel data;

wherein the selection means selects the dot arrangement pattern so that, among the plurality of first nozzle arrays and the plurality of second nozzle arrays, the first nozzle array and the second nozzle array in which an interval in the main scanning direction is relatively short are used for the printing of the same pixel.

In a second aspect of the present invention, there is provided a data processing apparatus for selecting a dot arrangement pattern corresponding to a quantization level of pixel data quantized to have an n value (n=3) in order to form ink dots on a printing medium by using a printing head while relative scanning between the printing head and the printing medium in a predetermined direction, the printing head being provided such that a plurality of nozzle arrays that can eject different inks are arranged along the predetermined direction in a contrasting manner, the apparatus comprising:

selection means for selecting, for each ink type, any one from a plurality of different dot arrangement patterns corresponding to the quantization level depending on the quantization level of the pixel data;

wherein the selection means selects the dot arrangement pattern so that the same pixel is printed by, among the plurality of nozzle arrays, the combination of nozzle arrays in which an interval in the predetermined direction is relatively short.

In a third aspect of the present invention, there is provided a data processing method for selecting a dot arrangement pattern corresponding to a quantization level of pixel data quantized to have an n value (n=3) in order to form ink dots on a printing medium by using a printing head while scanning the printing head in a main scanning direction, the printing head including at least a plurality of first nozzle arrays and a plurality of second nozzle arrays, the plurality of first nozzle arrays being able to form first ink dots and being arranged at an interval in the main scanning direction, the plurality of second nozzle arrays being able to form second nozzle arrays that can form second ink dots different from the first ink dots in at least the color or size and being arranged at an interval in the main scanning direction, the method comprising:

an selection step for selecting, for each of the first ink and second ink, any one from a plurality of different dot arrangement pattern corresponding to the quantization level depending on the quantization level of the pixel data;

wherein the allocation step selects the dot arrangement pattern so that the same pixel is printed by, among the plurality of first and nozzle arrays and the plurality of second nozzle arrays, the combination of first and second nozzle arrays in which an interval in the main scanning direction is relatively short.

In a fourth aspect of the present invention, there is provided a data processing method for selecting a dot arrangement pattern corresponding to a quantization level of pixel data quantized to have an n value (n=3) in order to form ink dots on a printing medium by using a printing head while relative scanning between the printing head and the printing medium in a predetermined direction, the printing head being provided such that a plurality of nozzle arrays that can eject different inks are arranged along the predetermined direction in a contrasting manner, the method comprising:

a selection step for selecting, for each ink type, any one from a plurality of different dot arrangement patterns corresponding to the quantization level depending on the quantization level of the pixel data; wherein the selection step selects the dot arrangement pattern so that the same pixel is printed by, among the plurality of nozzle arrays, the combination of nozzle arrays in which an interval in the predetermined direction is relatively short.

According to the present invention, a dot arrangement pattern allocated to image data is selected so that nozzle arrays having a short interval therebetween in the main scanning direction are used for the printing of the same pixel. This can suppress periodic density fluctuation in a printed image in the main scanning direction to print the image with a high quality.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, one embodiment of the present invention will be described with reference to the drawings.

(Configuration of Data Processing System)

Figure 1:
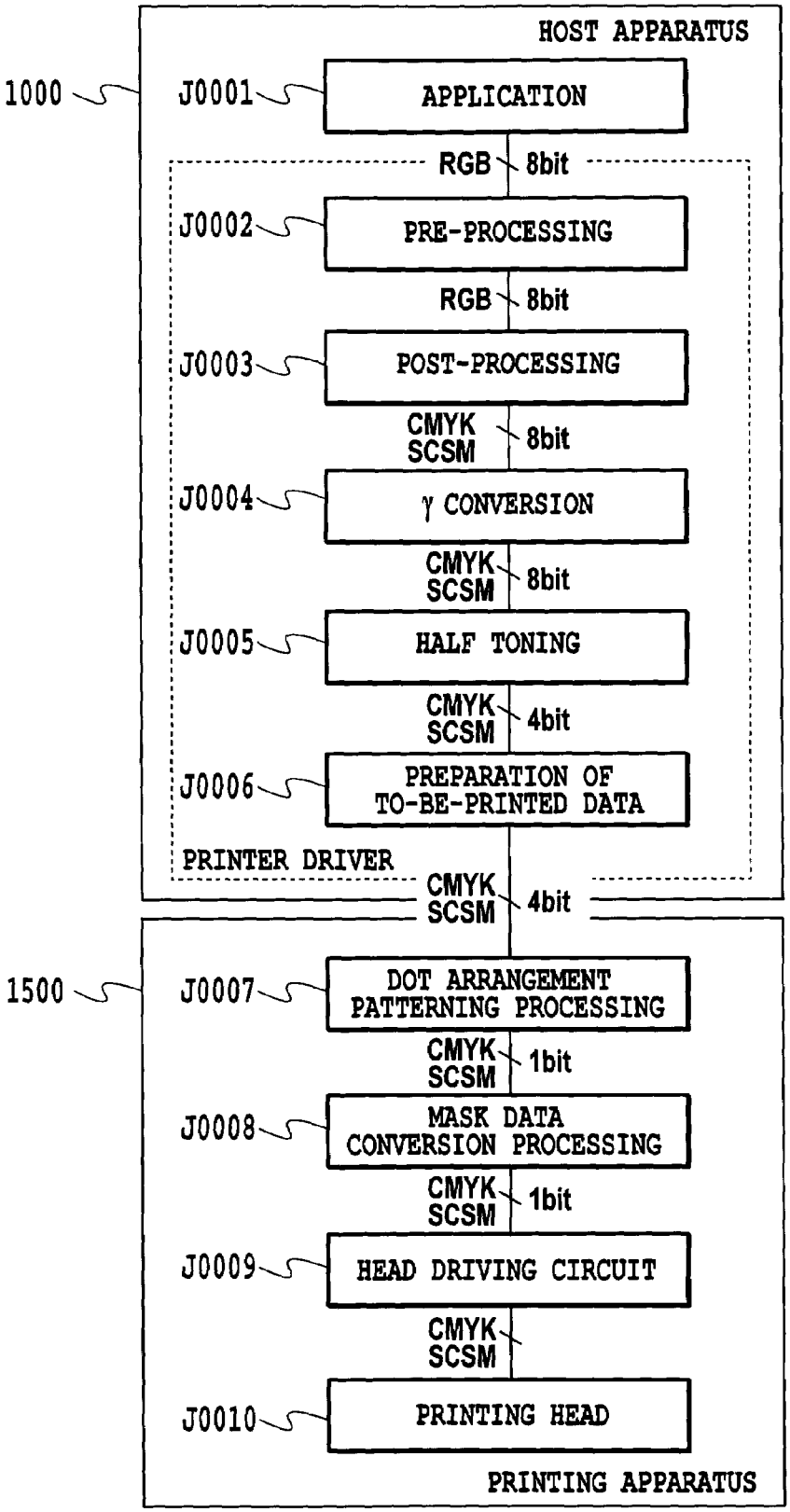
FIG. 1 is a block diagram illustrating a data processing system of a printing system in one embodiment of the present invention.

FIG. 1 is a block diagram illustrating a data processing system of a printing system according to one embodiment of the present invention.

The printing apparatus of this embodiment performs a printing by large dots of cyan ink (C), small dots of cyan ink (SC), large dots of magenta ink (M), small dots of magenta ink (SM), dots of yellow ink (Y), and dots of black ink (B). To provide the printing, printing heads for ejecting inks of these colors are used. The printing system of FIG. 1 is structured to include the printing apparatus using the printing head as described above (printer) 1500, and a personal computer (PC) as the host apparatus 1000 or a data processing apparatus.

Programs operating on an operating system of the host apparatus 1000 include an application or a printer driver. The application J0001 executes a processing for preparing image data to be printed by the printing apparatus 1500. This image data or data before being edited for example can be sent to a PC via various media. The PC of this embodiment can receive JPEG type image data taken by a digital camera for example via a CF (Compact Flash) card. The PC of this embodiment also can receive TIFF type image data read by a scanner or image data stored in a CD-ROM for example. Furthermore, the PC of this embodiment also can receive data on the Web via the Internet. These received data are displayed on a monitor of the PC to be subsequently subjected to editing or processing for example via the application J0001, thereby preparing, for example, image data R, G, and B according to standard sRGB. Then, in accordance with the printing instruction, this image data is sent to the printer driver.

The printer driver of this embodiment has, as the processing functions thereof, the pre-processing J0002, the post-processing J0003, the γ conversion J0004, the half toning J0005, and the to-be-printed data preparation J0006. The pre-processing J0002 performs a matching of the color gamut. The pre-processing J0002 of this embodiment uses a three-dimensional LUT (lookup table) and an interpolation calculation to perform a data processing for converting 8 bit image data R, G, and B to the data R, G, and B within the color gamut of the printing apparatus. The three-dimensional LUT shows the relation between the color gamut reproduced by the image data R, G, and B according to standard sRGB and the color gamut reproduced by the printing apparatus of this printing system within which the former is mapped. The post-processing J0003 calculates, based on the data R, G, and B thus subjected to the color gamut mapping, the color separation data Y, M, SM, C, SC, and K corresponding to the combination of inks for reproducing the colors represented by this data. In this embodiment, this post-processing is performed, as in the case of the pre-processing, by the use of the three-dimensional LUT and the interpolation calculation.

The γ conversion J0004 performs a tone value conversion of each color separation data calculated by the post-processing J0003. Specifically, one-dimensional LUT depending on the tone characteristic of each color ink of the printing apparatus in this system is used to provide a conversion by which the color separation data is linearly associated with the tone characteristic of the printer. The half toning J0005 subjects the respective 8 bit color separation data Y, SM, M, C, SC, and K to the quantization for converting the data to 4 bit data. This embodiment uses the error diffusion method to convert 8 bit data to 4 bit data. The 4 bit data is such data that works as an index for representing an arrangement pattern in the patterning processing of the dot arrangement in the printing apparatus. Finally, the to-be-printed data reparation processing J0006 adds printing control information to the to-be-printed image data containing the 4 bit index data, thereby preparing to-be-printed data.

The above-described processings of the application and the printer driver are executed by a CPU in accordance with these programs. In execution, these programs are read from a ROM or a hard disk and are used. When the processing is executed, a RAM is used as a work area.

With regards to the data processing, the printing apparatus performs the dot arrangement patterning processing J0007 and the mask data conversion processing J0008. The dot arrangement patterning processing J0007 arranges dots for each pixel corresponding to an actual to-be-printed image based on a dot arrangement pattern corresponding to the 4 bit index data (tone value information) as data of the to-be-printed image. In this way, each pixel expressed by 4 bit data is allocated with a dot arrangement pattern corresponding to the tone value of the pixel. As a result, ON and OFF of dots with regards to the respective areas in the pixel are defined and ink ejection data of "1" or "0" are provided to each area within one pixel.

The one bit ejection data thus obtained is subjected to the mask processing by the mask data conversion processing J0008. Specifically, in order to complete a printing operation to a scanning region having a predetermined width by the printing head through a plurality of scanning operations, ink ejection data for each scanning operation is generated by a processing using a mask corresponding to each scanning operation. Ejection data Y, M, SM, C, SC, and K for the respective scanning operations is sent, with an appropriate timing, to a head driving circuit J0009. As a result, the printing head J0010 is driven to eject the respective inks in accordance with the ejection data. It is noted that the dot arrangement patterning processing J0007 and the mask data conversion processing J0008 in the printing apparatus are performed using an exclusive hardware circuit and under the control by a CPU constituting the control section of the printing apparatus.

These processings also may be performed by the CPU in accordance with a program or may be performed by a printer driver in the PC for example. Specifically, a way in which these processings are performed in the application of the present invention is not limited, as is clear from the description shown below.

In this specification, the term "pixel" means a minimum unit by which a tone can be expressed and is a minimum unit that can be subjected to an image processing of multiple value data having a plurality of bits (e.g., the above-described pre-processing, post-processing, γ conversion processing, half toning processing). In the dot arrangement patterning processing of this example, one pixel corresponds to a pattern composed of 2×4 regions and each region in one pixel is defined as "area". The term "area" means a minimum unit by which ON and OFF of a dot is defined. In relation to this, the term "image data" in the pre-processing J0002, the post-processing J0003, and the γ conversion J0004 represents a collection of pixels to be processed in which each pixel has a 8 bit tone value in this embodiment. The term "pixel data" in the half toning J0005 represents to-be-processed pixel data itself. In the half toning J0005 of this embodiment, the pixel data having a 8 bit tone value is converted to pixel data having a 4 bit tone value (index data).

(Entire Structure of Ink Jet Printing Apparatus)

Figure 2:
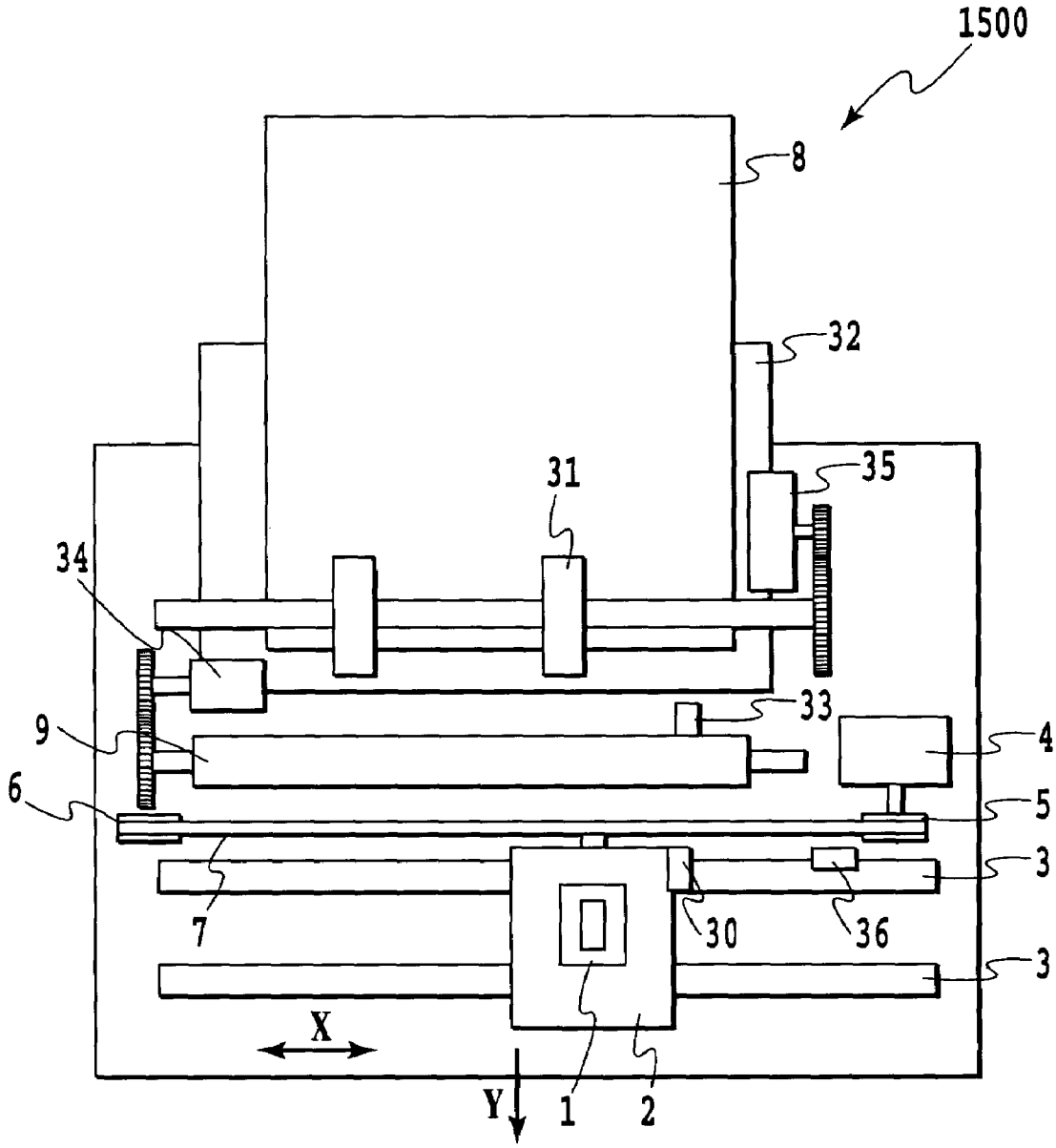
FIG. 2 is a schematic view of the printing apparatus in FIG. 1.

FIG. 2 illustrates an example of the basic structure of the main part of an ink jet printing apparatus 1500.

In FIG. 2, ahead cartridge 1 is included in a carriage 2 in an exchangeable manner. The head cartridge 1 has a printing head section and an ink tank section and also includes a connector (not shown) for sending and receiving a signal for driving the printing head section. The head cartridge 1 is positioned in the carriage 2 in an exchangeable manner. The carriage 2 includes, via the connector in the heat cartridge 1, a connector holder (electric connection section) for transmitting a driving signal or the like to the head cartridge 1.

The carriage 2 is guided and supported so that the carriage 2 can have a reciprocating movement along guide shafts 3 that is included in an apparatus body so as to extend in the main scanning direction shown by the arrow X. This carriage 2 is driven by a driving force of a main scanning motor (carriage motor) 4 via a driving mechanism composed of a motor pulley 5, a driven pulley 6, and a timing belt 7 for example and is controlled with regards to the position and movement. The carriage 2 also includes a home position sensor 30. The position of the carriage 2 can be known when the home position sensor 30 on the carriage 2 passes a position of a blocking plate 36.

By rotating a pickup roller 31 via a gear by a driving force of a paper feeding motor 35, a printing media 8 (e.g., printing paper, thin plastic plate) are separated one by one and sent by an auto sheet feeder (hereinafter also referred to as "ASF") 32 and are fed. Then, the printing medium 8 is sent by the rotation of a transportation roller 9 to a position opposed to a ejection opening face of the head cartridge 1 (face including ejection openings) (print section) and is transported in the sub scanning direction shown by the arrow "Y". The transportation roller 9 is rotated by a LF motor (paper feeding motor) 34 via a gear. In this rotation, determination regarding whether the printing medium 8 is fed or not and fixation of the front end alignment position of the printing medium 8 during the paper feeding are performed when the printing medium 8 passes a position of a paper end sensor 33. The paper end sensor 33 is also used to find the current printing position based on the rear end position of the printing medium 8 and the actual rear end position of the printing medium 8.

The back face of the printing medium 8 is supported by a platen (not shown) so that a flat printing face can be provided at the printing position. In the head cartridge 1 included in the carriage 2, the ejection opening face is retained so as to be protruded in a lower direction from the carriage 2 and the ejection opening face is provided, between two pairs of transportation rollers 3, to be parallel with printing face of the printing medium 8.

(Structure of Printing Head)

The head cartridge 1 is an ink jet head cartridge that uses heat energy to eject ink for example and includes an electrothermal converter for generating heat energy. Specifically, the printing head section in the head cartridge 1 can use heat energy generated by the electrothermal converter to cause a film boiling in the ink to use the pressure of bubbles by the film boiling, thereby ejecting ink from the ejection opening. However, an ink ejection method is not limited to this and may be any method such as the one for using a piezoelectric element to eject ink for example.

Figure 3:
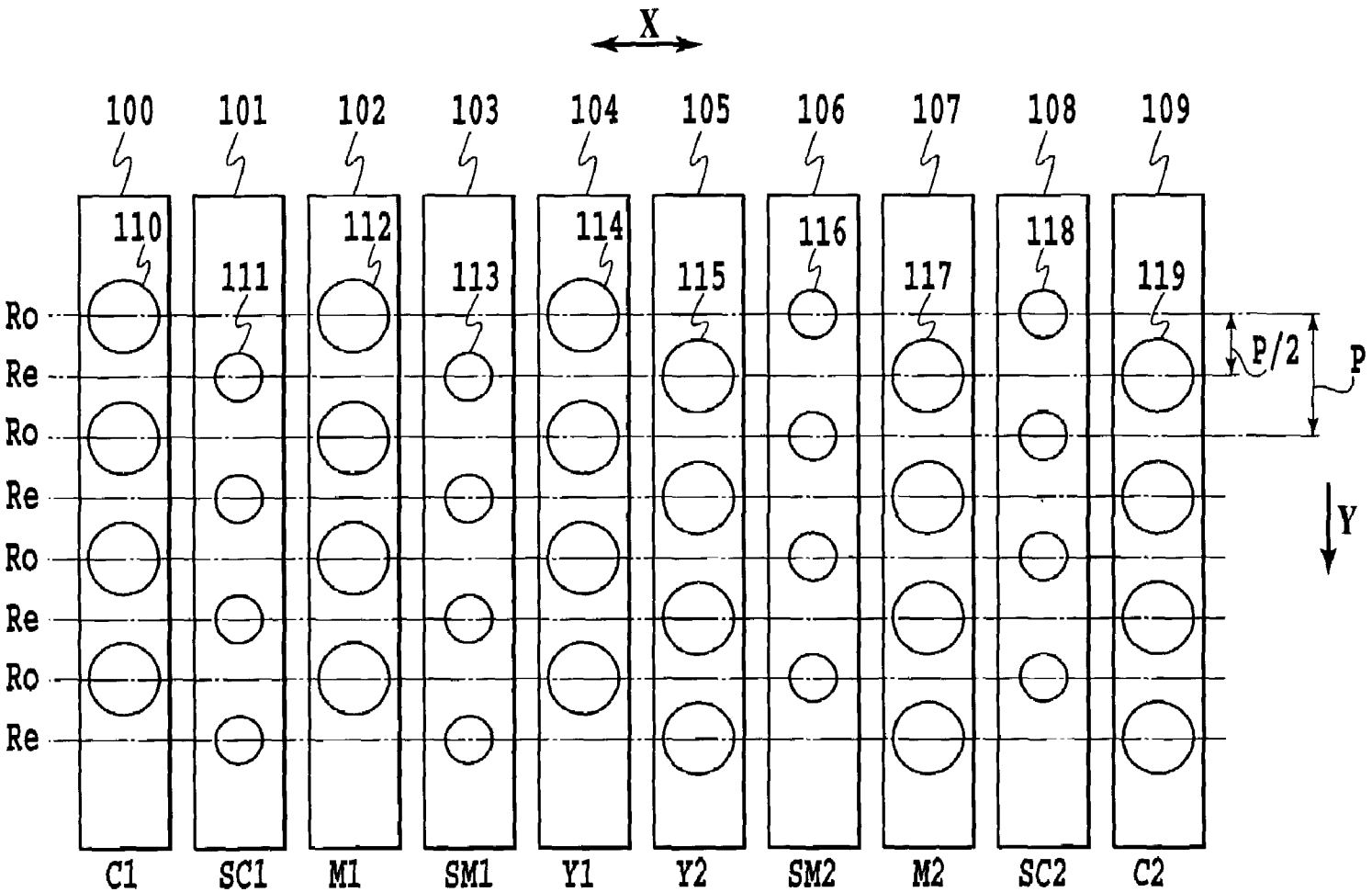
FIG. 3 illustrates a nozzle array of a printing head in the printing apparatus of FIG. 2.

FIG. 3 is a schematic view illustrating the main part of the printing head section in the head cartridge 1.

In FIG. 3, reference numeral 100 denotes the first large cyan dot formation printing head (C1) for ejecting, from the ejection opening 110, a relatively large amount of cyan ink (the first ejection amount); and reference numeral 101 denotes the first small cyan dot formation printing head (SC1) for ejecting, from the ejection opening 111, a relatively small amount of cyan ink (which is the second ejection amount smaller than the first ejection amount). Reference numeral 102 denotes the first large magenta dot formation printing head (M1) for ejecting, from the ejection opening 112, a relatively large amount of magenta ink (the first ejection amount). Reference numeral 103 denotes the first small magenta dot formation printing head (SM1) for ejecting, from the ejection opening 113, a relatively small amount of magenta ink (which is the second ejection amount smaller than the first ejection amount). Reference numeral 104 denotes the first yellow ink printing head (Y1) for ejecting, from the ejection opening 114, yellow ink.

Reference numeral 105 denotes the second yellow ink printing head (Y2) for ejecting, from the ejection opening 115, yellow ink. Reference numeral 106 denotes the second small magenta dot formation printing head (SM2) for ejecting, from the ejection opening 116, a relatively small amount of magenta ink. Reference numeral 107 denotes the second large magenta dot formation printing head (M2) for ejecting, from the ejection opening 117, a relatively large amount of magenta ink. Reference numeral 108 denotes the second small cyan dot formation printing head (SC2) for ejecting, from the ejection opening 118, a relatively small amount of cyan ink. Reference numeral 109 denotes the second large cyan dot formation printing head (C2) for ejecting, from the ejection opening 119, a relatively large amount of cyan ink.

The ejection openings 110 and 119 of the printing heads C1 and C2 are displaced, by a half of the nozzle pitch P, to each other in the sub scanning direction. Similarly, the ejection openings of the printing heads SC1 and SC2, the ejection openings of the printing heads M1 and M2, the ejection openings of the printing heads SM1 and SM2, and the ejection openings of the printing heads Y1 and Y2 are also displaced, by a half of the nozzle pitch P, to each other in the sub scanning direction, respectively. Although not shown, a printing head for ejecting black ink is also structured similarly and is aligned with the color ink ejection printing heads of FIG. 3 in the main scanning direction. The ejection openings 110, 112, 114, 116, and 118 are positioned on the odd number raster RO and the ejection openings 111, 113, 115, 117, and 119 are positioned on the even number raster Re.

The head cartridge 1 is structured by collecting these printing heads as one group. In the head cartridge 1, the respective printing heads include ejection opening arrays (nozzle arrays) as described above. Nozzle groups in the respective printing heads are arranged in a direction crossing the main scanning direction (a direction almost orthogonal to the main scanning direction in this example). Strictly speaking, there may be a case in which, due to the relation between nozzle groups and a timing at which ink is ejected, the nozzle groups are arranged to be slightly inclined to the main scanning direction. Nozzle groups in the respective printing heads are arranged in the main scanning direction. Specifically, the respective printing heads are arranged in the main scanning direction to provide a so-called lateral arrangement. Furthermore, the head cartridge 1 also may be provided by integrally forming the above plurality of printing heads or by separately providing the plurality of printing heads.

(Configuration of Control System)

Figure 4:
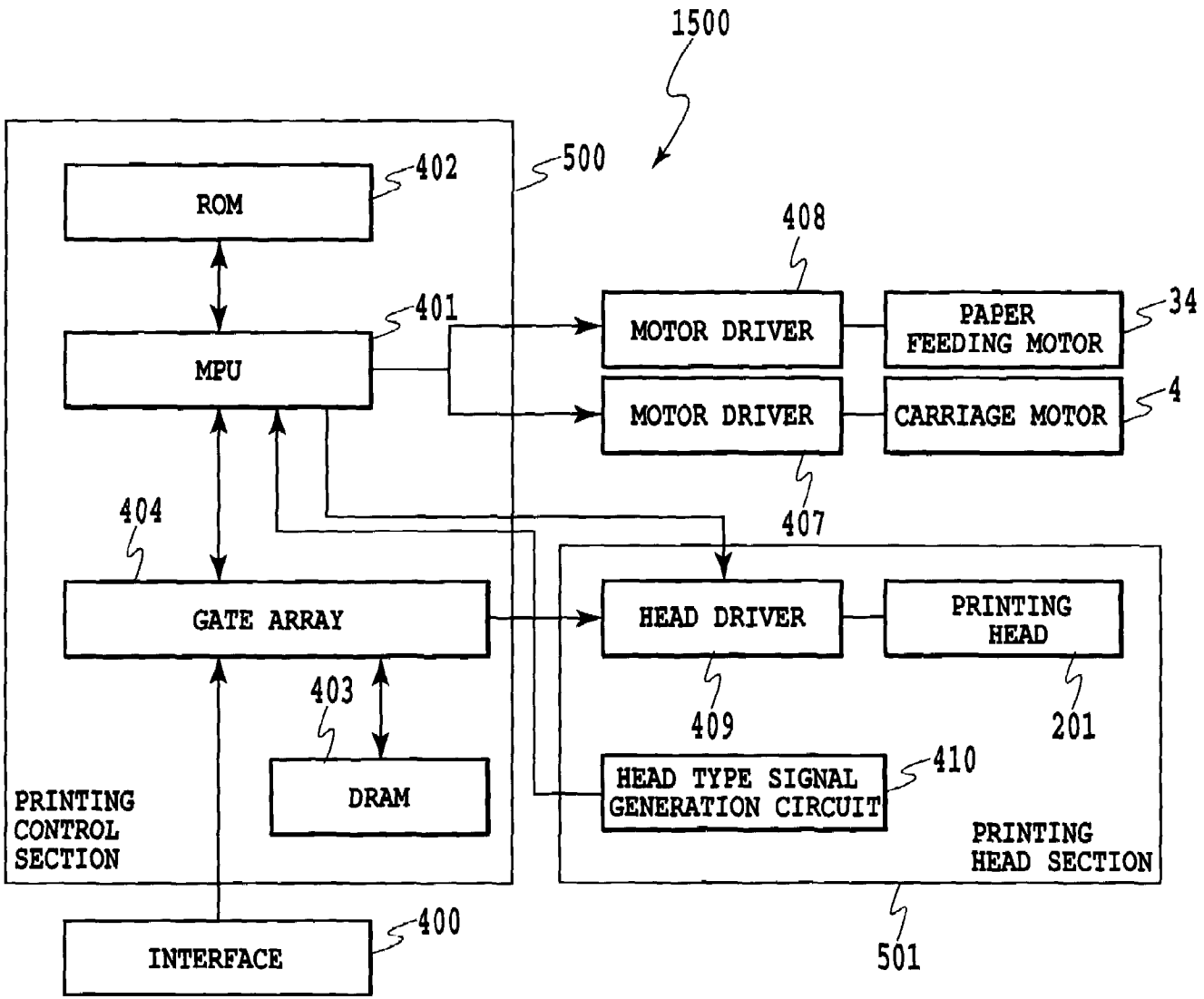
FIG. 4 is a block diagram illustrating a control system in the printing apparatus of FIG. 2.

FIG. 4 is a block diagram illustrating a control system of the printing apparatus as described above.

In FIG. 4, reference numeral 400 denotes an interface for inputting a printing signal; reference numeral 401 denotes an MPU; reference numeral 402 denotes a program ROM for storing a control program executed by the MPU 401; and reference numeral 403 denotes a dynamic type RAM (DRAM) that stores various data (e.g., printing signal, image data supplied to a printing head) and that also can store the number of printing dots or the number at which the printing head was exchanged for example. Reference numeral 404 denotes a gate array for controlling the supply of image data to the printing head 201 of the printing head section 501 that also controls the transfer of data among the interface 400, the MPU 401, and the DRAM 403. As described above, reference numeral 4 denotes the carriage motor for transporting the printing head 201 together with the carriage 2 in the main scanning direction and reference numeral 34 denotes the transportation motor for transporting the printing medium 8 in the sub scanning direction. Reference numerals 407 and 408 denote a motor driver for driving the carriage motor 4 and the transportation motor 34. Reference numeral 409 denotes a head driver for driving the printing head 201.

Figure 5:
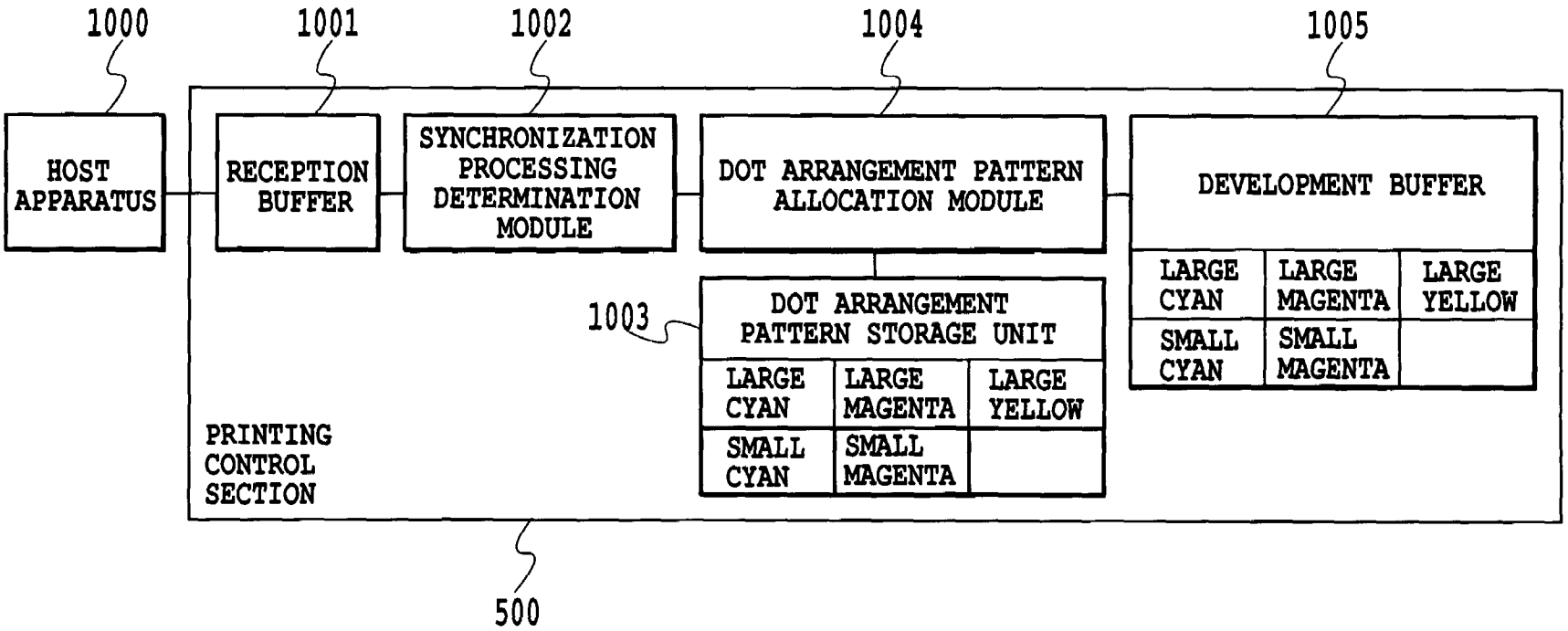
FIG. 5 is a block diagram illustrating a printing control section in FIG. 4.

FIG. 5 is a block diagram illustrating the printing control section 500.

In the printing control section 500, reference numeral 1001 denotes a reception buffer for receiving quantized data from the host apparatus 1000; and reference numeral 1002 denotes a synchronization processing determination module for determining the necessity of the synchronization of dot arrangement patterns. Reference numeral 1003 denotes a dot arrangement pattern storage unit for storing the synchronization processed-dot arrangements. Reference numeral 1004 denotes a dot arrangement allocation module for using dot arrangement patterns to allocate the dot arrangement patterns to the quantized data in the reception buffer 1001. A development buffer (print buffer) 1005 uses the dot arrangement patterns allocated by the dot arrangement pattern allocation module 1004 to develop the quantized data. The synchronization processing determination module 1002 and the dot arrangement pattern allocation module 1004 are a software module that is previously stored in the ROM 402 and that is executed by the MPU 401. The reception buffer 1001, the dot arrangement pattern storage unit 1002, and the development buffer 1004 are prepared in a predetermined address region of the DRAM 403.

As described later, the dot arrangement pattern storage unit 1003 stores a plurality of dot arrangement patterns among which any pattern is selected and the selected pattern is developed by the development buffer 1005. In this embodiment, the host apparatus 1000 quantizes the image data into 9 value (4 bit) data having the resolution of 600 dpi (lateral)×600 dpi (longitudinal). The printing apparatus 1500 develops the quantized image data into image data of 2400 dpi (lateral)×1200 dpi (longitudinal) (4×2 dot arrangement pattern) to subject the data to a printing.

(Dot Arrangement Pattern)

Figure 6:
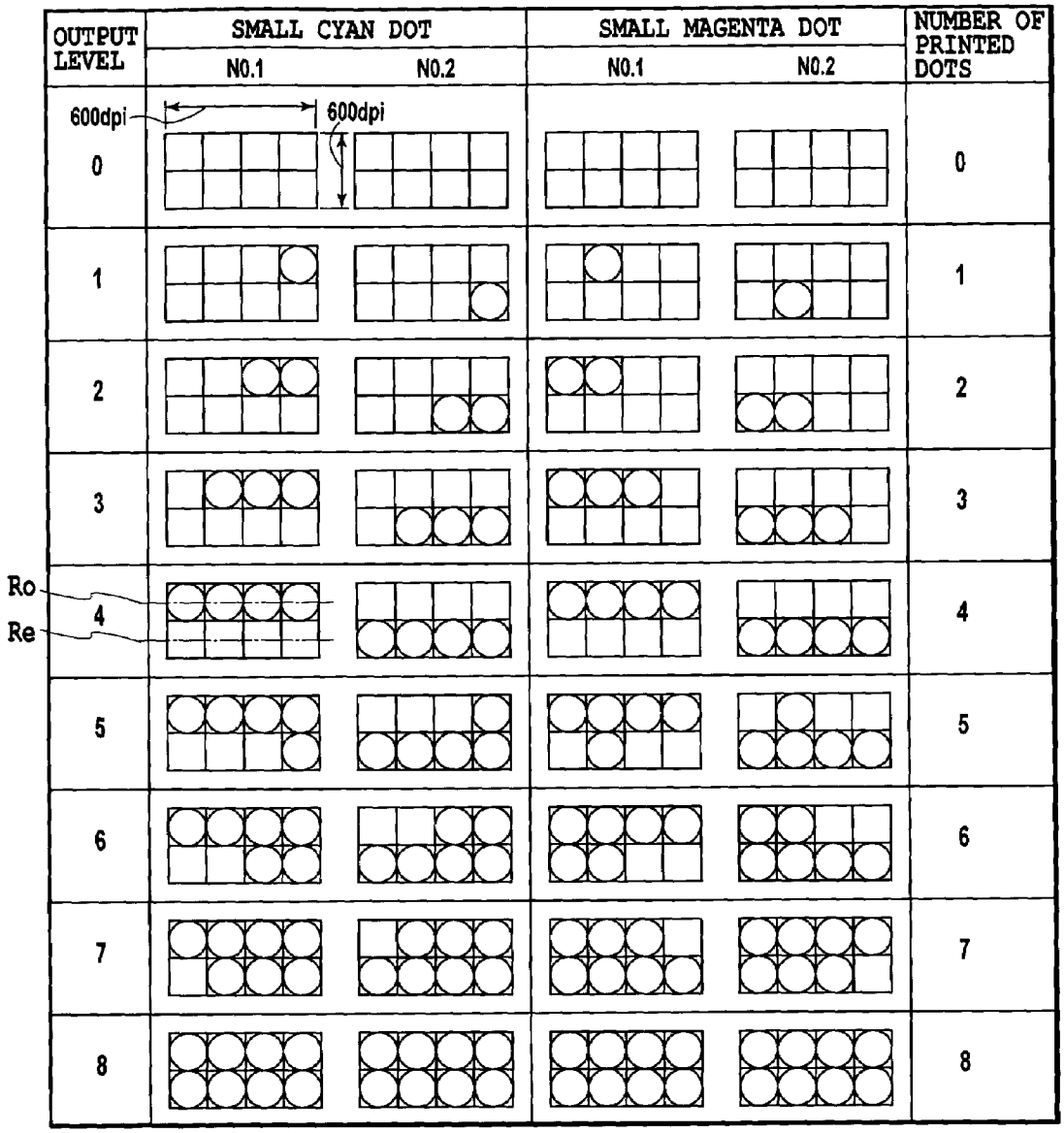
FIG. 6 illustrates a dot arrangement pattern stored in a dot arrangement pattern storage unit in FIG. 5.

FIG. 6 illustrates dot arrangement patterns stored in the dot arrangement pattern storage unit 1004. The dot arrangement patterns are stored such that the dot arrangement patterns are allocated with numbers (NO. 1, NO. 2) so that the patterns correspond, with regards to each ink color, to quantized data having signal levels (tone levels) ranging from level 0 to level 8. FIG. 6 typically illustrates dot arrangement patterns for forming small cyan (SC) dots and small magenta (SM) dots. For convenience, the maximum two types of patterns (NO. 1 and NO. 2) can be stored for a single level of quantized data. However, the present invention is not limited to this and the number of stored patterns may be optimally determined depending on the structure of the printing apparatus for example. When the number of patterns corresponding to a single level of quantized data is not equal to or higher than two, then the same pattern is used for convenience.

In a dot arrangement pattern of this example, one pixel of 600 dpi×600 dpi is divided into eight (2×4) areas. With regards to area on the odd number raster Ro, corresponding dots are formed by a printing head having ejection openings on this odd number raster Ro as shown in FIG. 3. Similarly, with regards to area on the even number raster Re, corresponding dots are formed by a printing head having ejection openings on this even number raster Re. When small cyan dots are formed as shown in FIG. 6, areas on the odd number raster Ro have thereon dots formed by the second printing head SC2 while areas on the even number raster Re have thereon dots formed by the first printing head SC1. Similarly, when small magenta dots are formed, areas on the odd number raster Ro have thereon dots formed by the second printing head SM2 while areas on the even number raster Re have thereon dots formed by the first printing head SM1.

The dot arrangement patterns as described above correspond to tone levels (output levels) represented by the quantized data after the above-described half toning J0005 in the host apparatus.

Figure 7:
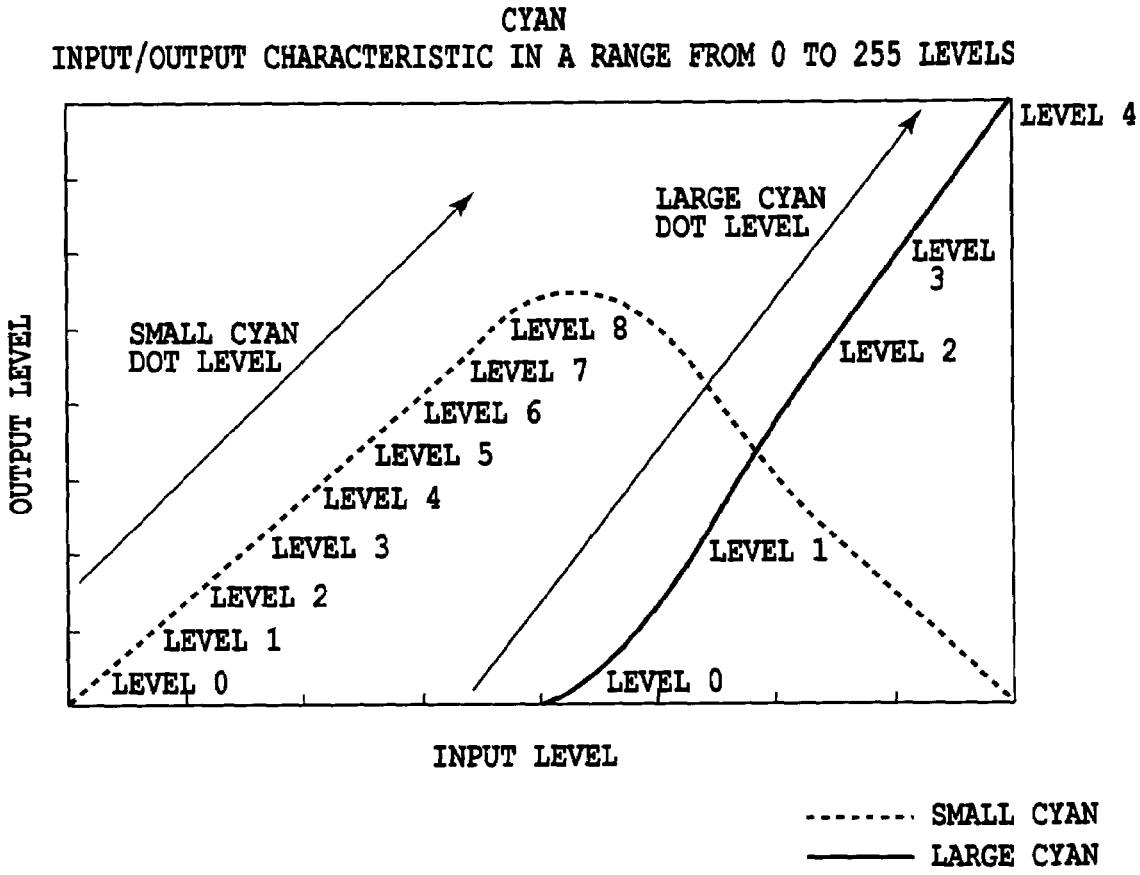
FIG. 7 illustrates a signal level before and after a half toning in a host apparatus of FIG. 1.

FIG. 7 illustrates signal levels before and after the half toning J0005 in the host apparatus. FIG. 7 illustrates, in an example of the data C and SC for forming large and small cyan inks, the input levels 0 to 255 (signal levels 0 to 255 obtained by the γ conversion J0004) and the corresponding output levels after the half toning J0005.

Output levels in this example are corresponding to levels 0 to 8 for forming small cyan dots and levels 0 to 4 for forming large cyan dots. The levels for forming small cyan dots are 9-valued and the levels for forming large cyan dots are 5-valued so that, with regards to each level, NO. 1 or NO. 2 dot arrangement pattern in FIG. 6 is selected and allocated thereto.

As can be seen from FIG. 7, when the half tone region having the input level 128 for example is printed, the first and second printing heads SC1 and SC2 are used to form small cyan dots to print the image. When an half tone region of a color image is printed on the other hand, not only the printing heads SC1 and SC2 but also the printing heads SM1, SM2, Y1, and Y2 are used.

Figure 8A:
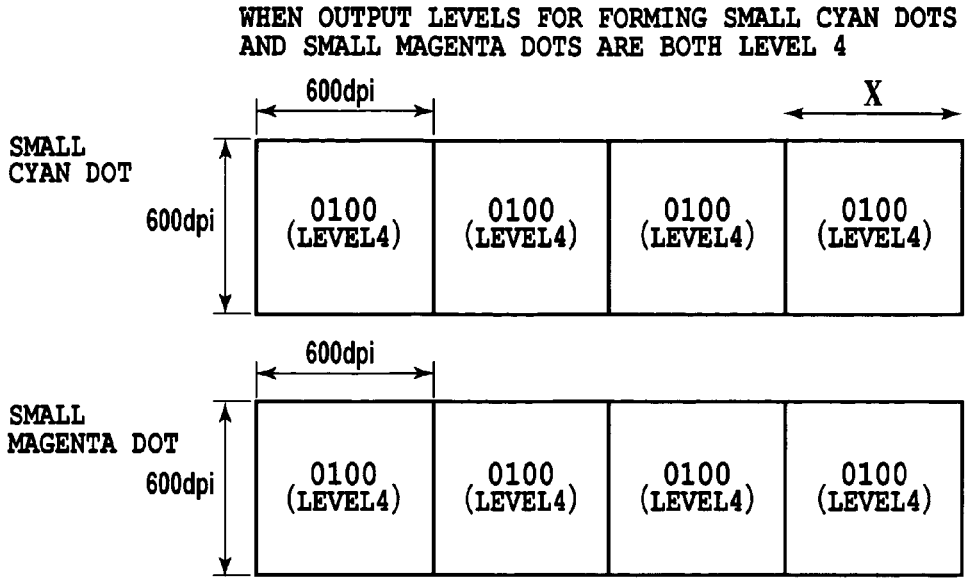
FIG. 8A illustrates data levels for providing a small cyan dot and a small magenta dot.

When an image is printed by small cyan dots, the image in which tones of only the level 4 are continued for example is printed by continuously using the small cyan dot formation dot arrangement patterns of the level 4 in FIG. 6 as shown in FIG. 8A. Similarly, when an image is printed by small magenta dots, the image in which tones of only the level 4 are continued for example is printed by continuously using the small magenta dot formation dot arrangement patterns of level 4 in FIG. 6 as shown in FIG. 8A.

When the pattern of No. 1 is selected among the level 4 small cyan dot formation patterns, the second printing head SC2 forms dots on the odd number raster Ro and, when the pattern of No. 2 is selected among them, the first printing head SC1 forms dots on the even number raster Re.

Similarly, when the pattern of No. 1 is selected among the level 4 small magenta dot formation patterns, the second printing head SM2 forms dots on the odd number raster Ro and, when the pattern of No. 2 is selected among them, the first printing head SM1 forms dots on the even number raster Re.

Figure 8B:
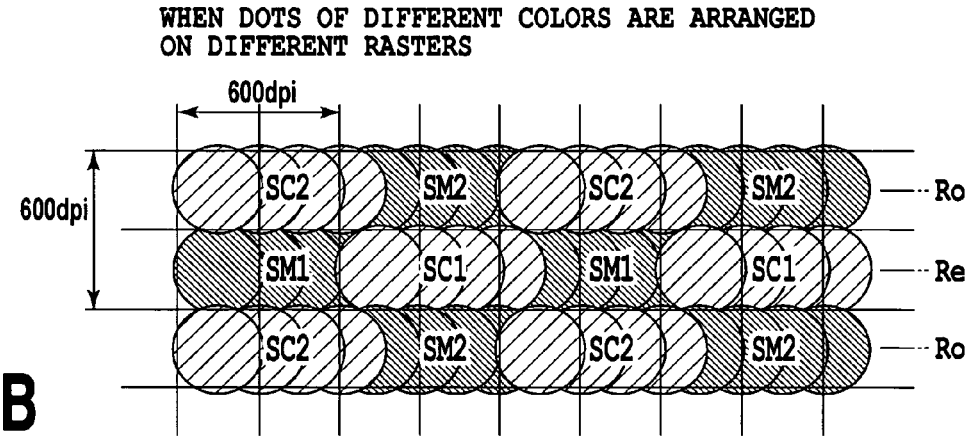
FIG. 8B illustrates an example of dot arrangement provided by the data levels of FIG. 8A.
Figure 8C:
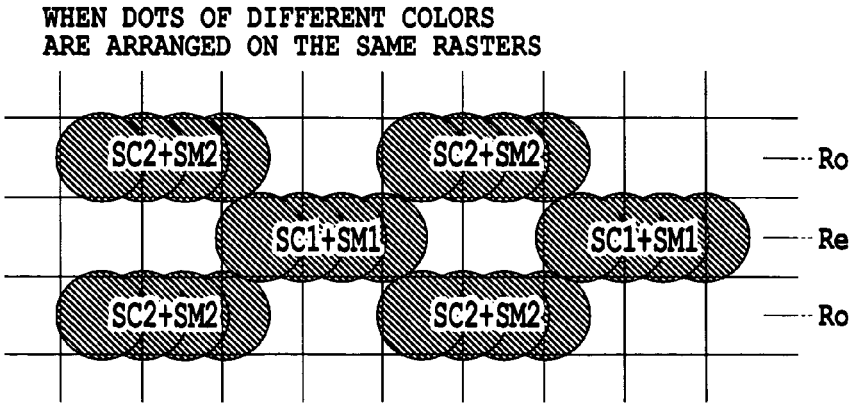
FIG. 8C illustrates another example of dot arrangement provided by the data levels of FIG. 8A.

In a case in which the level 4 small cyan dots and the level 4 small magenta dots as described above are formed continuously within the same pixel and in which selection is made so that the existence or nonexistence of image data within the pixel array is determined to alternately switch the NO. 1 pattern and the NO. 2 pattern, dots are formed as shown in FIG. 8B or FIG. 8C. In the case of FIG. 8B, small cyan dots and small magenta dots within the same pixel are formed on different rasters by the second printing head SC2 and the first printing head SM1 or by the first printing head SC1 and the second printing head SM2. In the case of FIG. 8C on the other hand, small cyan dots and small magenta dots within the same pixel are formed on the same raster by the second printing head SC2 and the second printing head SM2 or by the first printing head SC1 and the first printing head SM1. When the existence or nonexistence of pixel data within a pixel array is determined independently with regards to small cyan and small magenta to alternately select No. 1 pattern and No. 2 pattern whenever pixel data exists, the probability with which the dot arrangement is any of that shown in FIG. 8B or that shown in FIG. 8C is almost the same.

The dot arrangements shown in FIG. 8B and FIG. 8C have a relation with the displacement of ink impact position that is characterized as shown below.

Figure 9A:
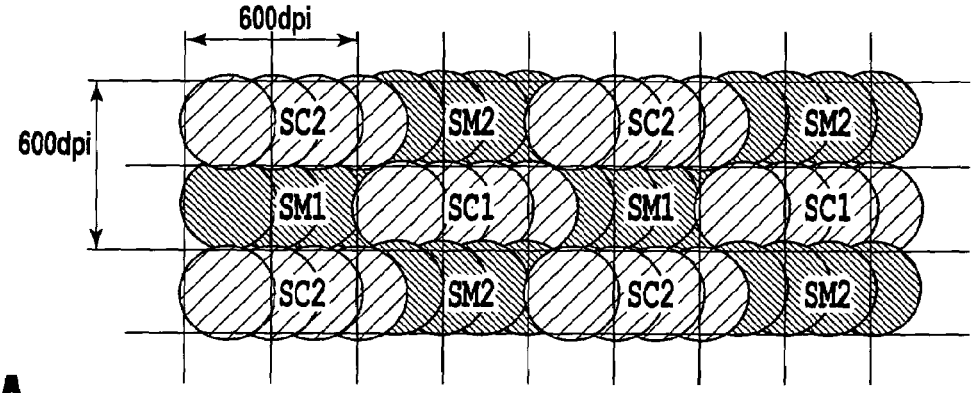
FIG. 9A illustrates a case where the displacement of the ink impact position is caused, in the dot arrangement of FIG. 8B, of 5 μm in the sub scanning direction.
Figure 9B:
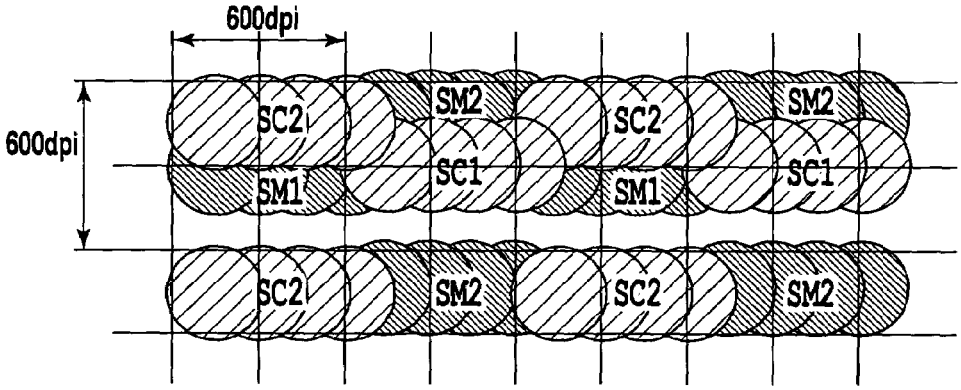
FIG. 9B illustrates a case where the displacement f the ink impact position is caused, in the dot arrangement of FIG. 8B, of 10 μm in the sub scanning direction.

In the dot arrangement of FIG. 8B, when the displacement of the ink impact position is caused in an amount of about 5 μm in the sub scanning direction, dots are formed as shown in FIG. 9A. When the displacement of the ink impact position is caused in an amount of 10 μm in the sub scanning direction, dots are formed as shown in FIG. 9B. When dots of different colors are arranged on different rasters within the same pixel as shown in FIG. 9A and FIG. 9B in level 4 that is mainly used as the half tone region, the difference in ink impact position in the sub scanning direction may cause a risk of causing the inconveniences as shown below.

(1) A relatively large change of the area factor is caused to cause a region having a relatively high density and a region having a relatively low density.

(2) A region in which dots of different colors interfere each other with a relatively high level and a region in which dots of different colors interfere each other with a relatively high low level are caused.

These factors cause a risk of causing uneven print density and uneven coloring with a cycle at which the displacement of the ink impact position in the sub scanning direction is caused in a printed image.

Figure 10A:
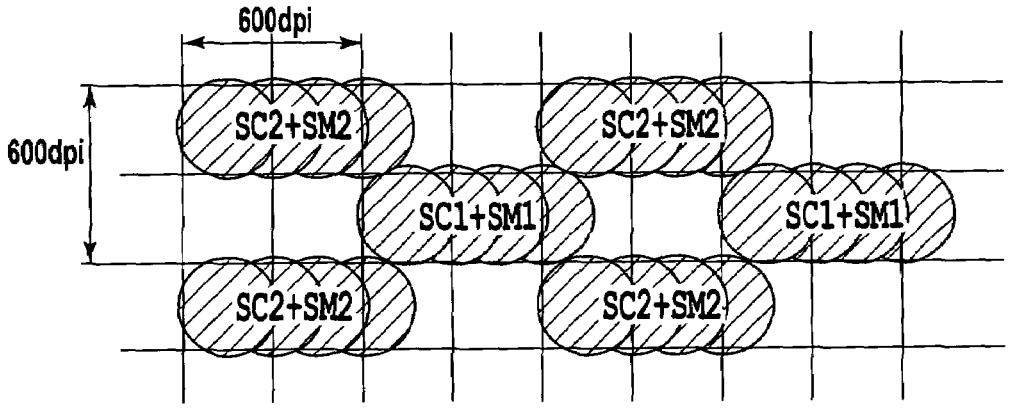
FIG. 10A illustrates a case where the displacement of the ink impact position is caused, in the dot arrangement of FIG. 8C, of 5 μm in the sub scanning direction.
Figure 10B:
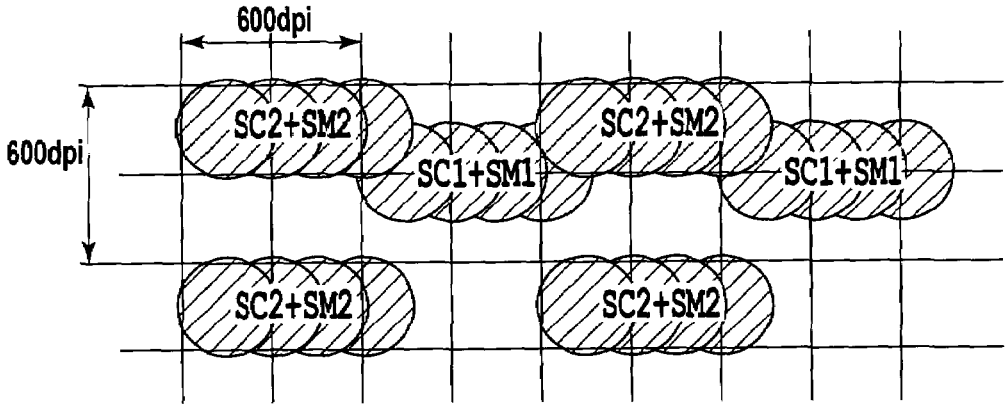
FIG. 10B illustrates a case where the displacement of the ink impact position is caused, in the dot arrangement of FIG. 8C, of 10 μm in the sub scanning direction.

In the dot arrangement of FIG. 8C on the other hand, when the displacement of the ink impact position is caused in an amount of about 5 μm in the sub scanning direction, dots are formed as shown in FIG. 10A. When the displacement of the ink impact position is caused in an mount of about 10 μm in the sub scanning direction, dots re formed as shown in FIG. 10B. When dots of different colors are formed within the same raster as shown in FIG. 10A and FIG. 10B, the change of the area factor is small even when the displacement of the ink impact position is caused in the sub scanning direction. Thus, in the case of FIG. 8C, the generation of uneven print density can be suppressed when compared to the case of the dot arrangement of FIG. 8B.

(Relation between Displacement of Ink Impact Positions and Distance between Nozzles)

Figure 11:
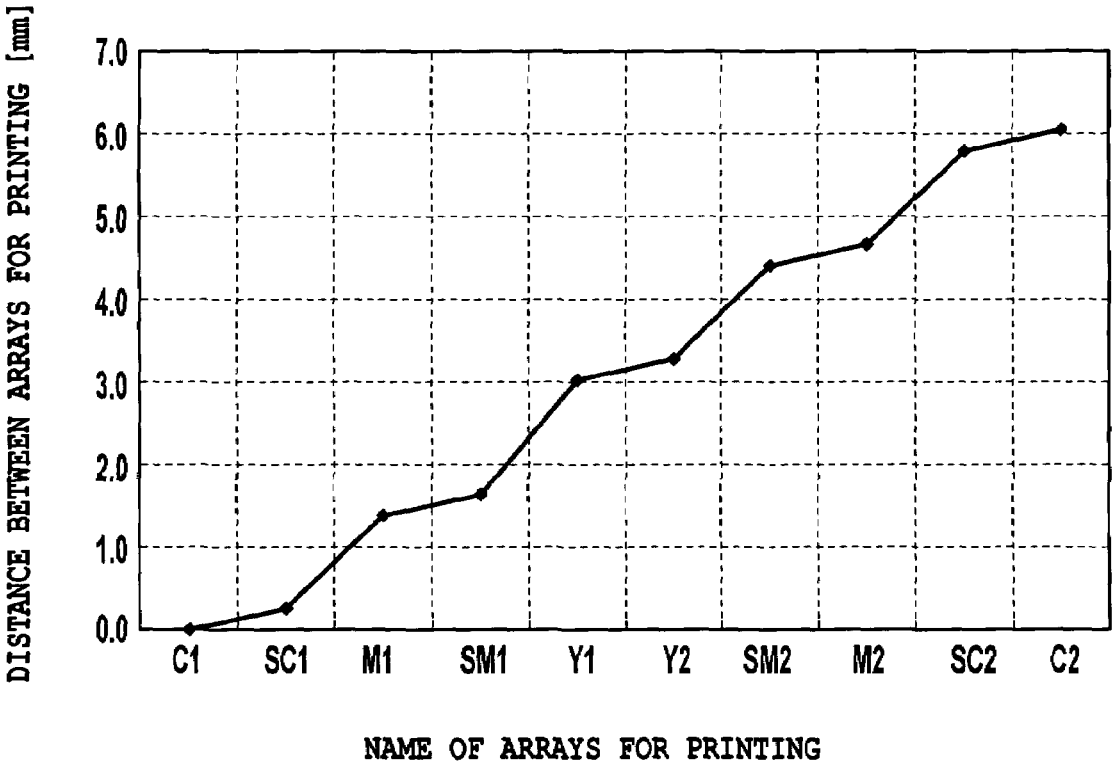
FIG. 11 illustrates the distance between nozzle arrays in the printing head of FIG. 3.

FIG. 11 and FIG. 12 illustrate the relation between the dislocation of the ink impact position in the sub scanning direction and the distance between nozzle arrays in a printing head.

In the case of this example, the respective nozzle arrays of the printing heads C1, SC1, M1, SM1, Y1, Y2, SM2, M2, SC2, and C2 are arranged while having the distances thereamong as shown in FIG. 11. When the position of the nozzle array of the printing head C1 is assumed as a reference position, the distance between this nozzle array and the nozzle array of the printing head C2 that is the farthest from this nozzle array is about 6.04 mm.

Figure 12A:
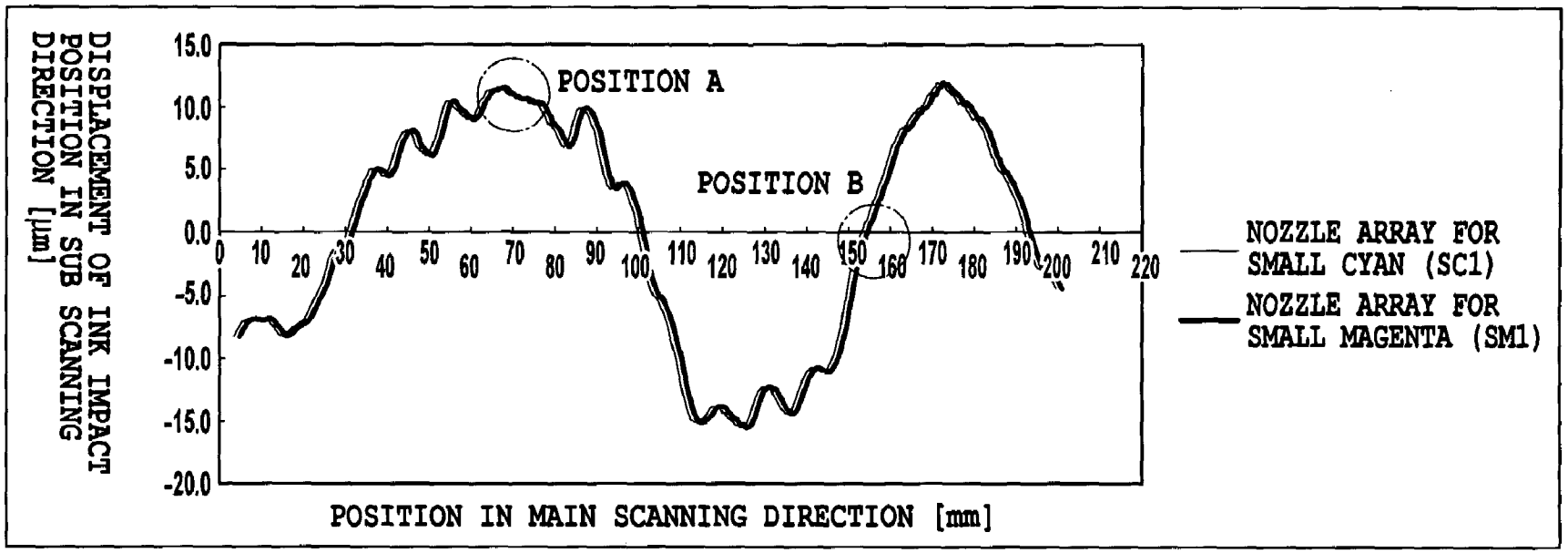
FIG. 12A illustrates the displacement of the ink impact position when the nozzle arrays SC1 and SM1 in the printing head of FIG. 3 are used.
Figure 12B:
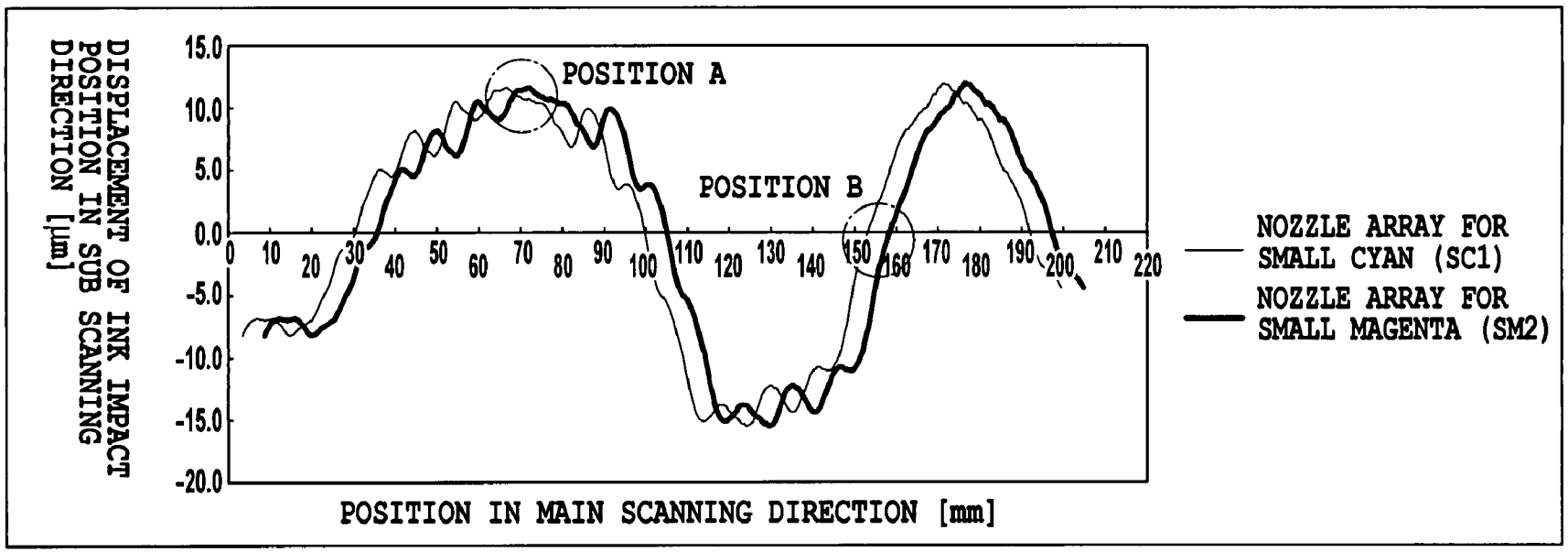
FIG. 12B illustrates the displacement of the ink impact position when the nozzle arrays SC1 and SM2 in the printing head of FIG. 3 are used.

In the case where small cyan dots and small magenta dots of level 4 are continuously formed within the same pixel, when nozzle arrays of the printing heads SC1 and SM1 (hereinafter referred to as "nozzle array SC1" and "nozzle array SM1", respectively) are used, the displacement of the ink impact position is caused as shown in FIG. 12A. When nozzle arrays of the printing heads SC1 and SM2 (hereinafter referred to as "nozzle array SC1" and "nozzle array SM2", respectively) are used, the displacement of the ink impact position is caused as shown in FIG. 12B. Furthermore, when small cyan dots of level 4 are continuously formed using nozzle arrays of the printing heads SC1 and SC2 (hereinafter referred to as "nozzle array SC1" and "nozzle array SC2"), the displacement of the ink impact position is caused as shown in FIG. 12C.

Figure 12C:
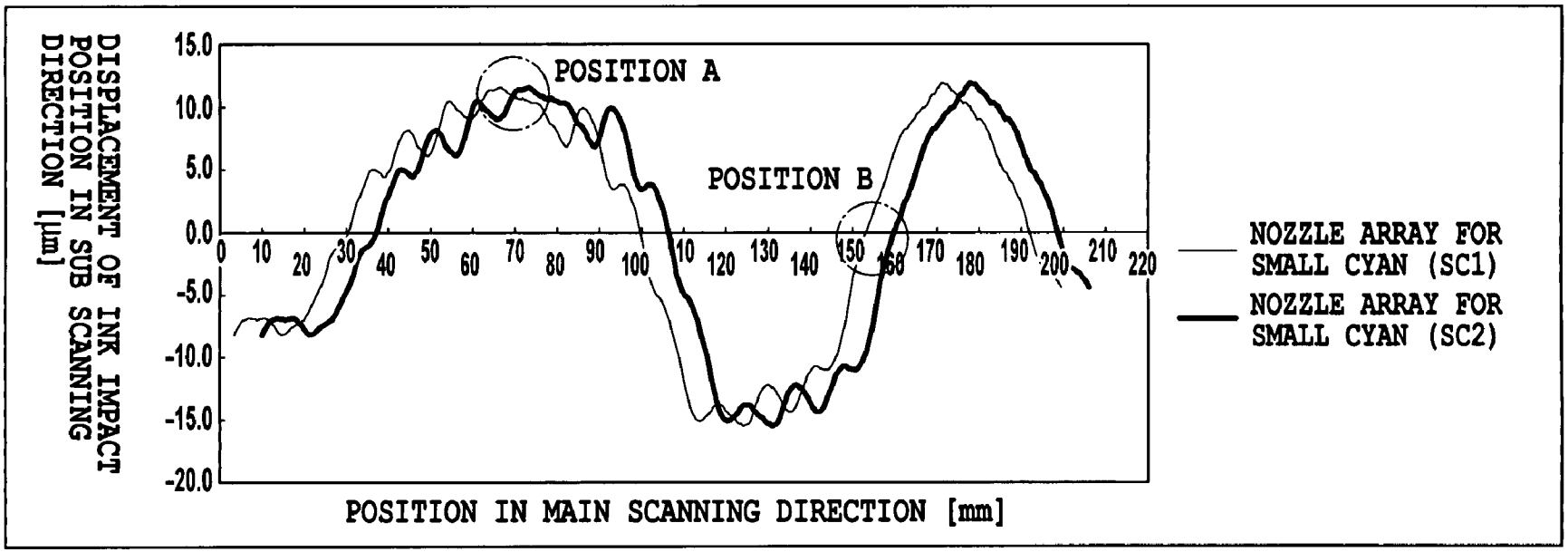
FIG. 12C illustrates the displacement of the ink impact position when the nozzle arrays SC1 and SC2 in the printing head of FIG. 3 are used.

With regards to FIG. 12A, FIG. 12B, and FIG. 12C, amounts of displacements of ink impact positions in the sub scanning direction are compared for the position A in the main scanning direction (in the vicinity of about 70 mm) and the position B (in the vicinity of about 155 mm).

At the position A, any combination of the nozzle arrays shows a relatively small displacement of about 3 μm between impact positions. At the position B on the other hand, displacement of impact positions in the sub scanning direction is small with regards to the combination between the nozzle arrays SC1 and SM1 having a short distance between nozzle arrays as shown in FIG. 12A. However, in the case of the combination between nozzle arrays SC1 and SM2 and the combination between SC1 and SC2 as shown in FIG. 12B and FIG. 12C in which the distance between the nozzle arrays in the main scanning direction is long, a large displacement of the ink impact position of about 8 μm is caused in the sub scanning direction. Specifically, the larger the distance between nozzle arrays is, the larger the displacement of ink impact position is. Although the reason has been not clarified yet, the present inventors estimate the reason as shown below. A sliding face of a carriage retaining a printing head (a face at which the carriage moves in main scan direction) is not always smooth and flat. When the sliding face of the carriage retaining the printing head includes a part in which the smoothness is lost, the absolute position of the printing head may be dislocated in the sub scanning direction during the main scanning. When a plurality of nozzle arrays are used for a printing, the displacement of the impact position in the sub scanning direction in accordance with the cycle of the lost smoothness causes a phase shift depending on the distance between nozzle arrays and is larger in proportion to the distance between the nozzle arrays.

In the dot arrangement as shown in FIG. 8B, nozzle arrays used for a printing of the same pixel are SC1 and SM2 or SM1 and SC2. These combinations have a long distance between nozzle arrays. Thus, the displacement of the ink impact position in the sub scanning direction is higher, which tends to cause the statuses as shown in FIG. 9A and FIG. 9B. As a result, a half tone image of blue in which cyan and magenta ink dots are formed tend to include periodic uneven print density in the main scanning direction.

In the case of the dot arrangement as shown in FIG. 8C on the other hand, nozzle array SC1 and SM1 or SM2 and SC2 are used for a printing of the same pixel and these combinations have a short distance between nozzle arrays. Thus, the displacement of the ink impact position in the sub scanning direction is small. Even when the displacement of the ink impact position in the sub scanning direction is caused, the statuses as shown in FIG. 10A and FIG. 10B are caused, thus suppressing periodic uneven print density in the main scanning direction from being caused.

This embodiment considers the relation between the displacement of the ink impact position and the distance between nozzles as described above to execute a synchronization processing of dot arrangement patterns as described later.

(Data Development Processing)

Figure 13:
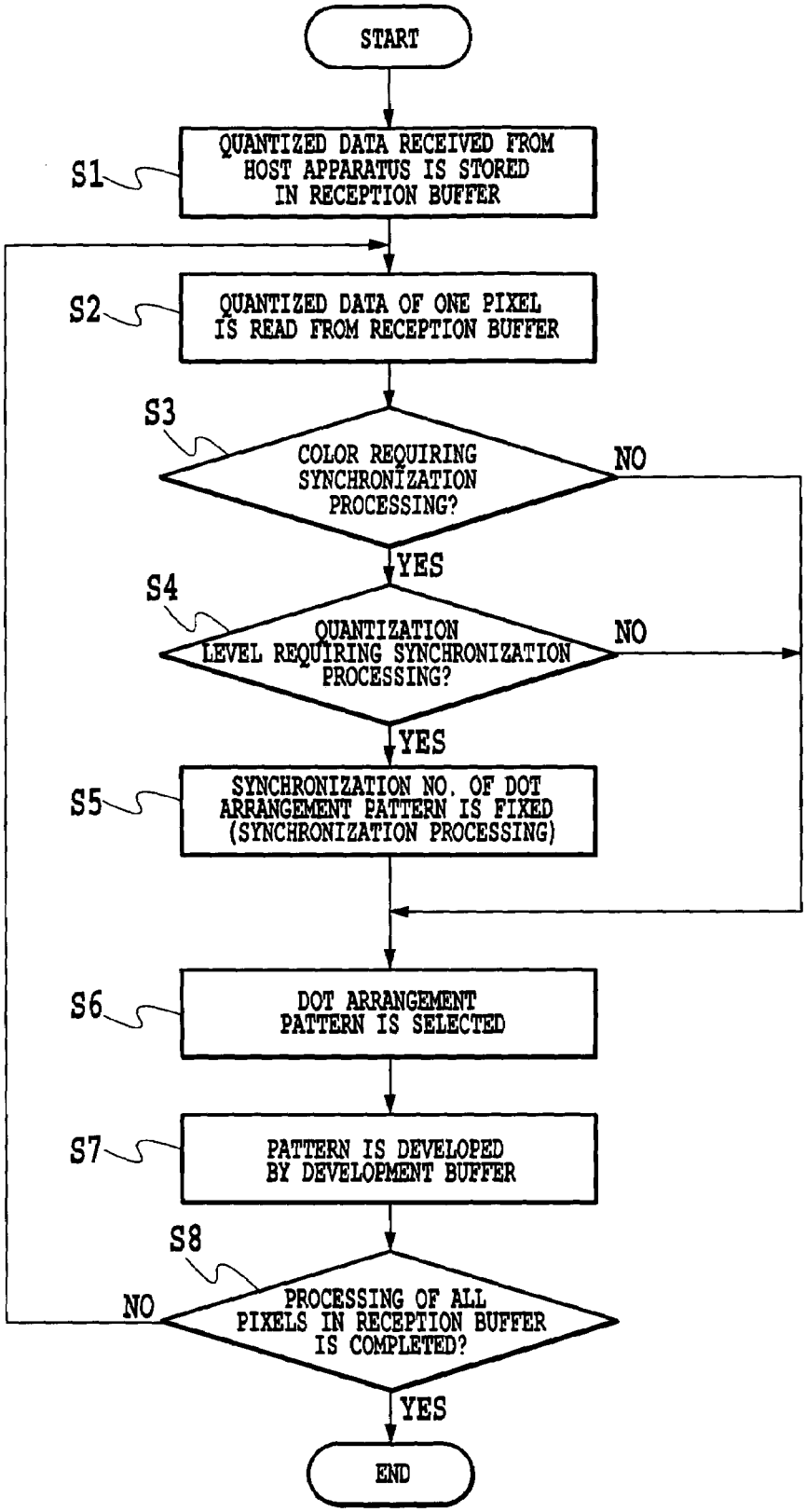
FIG. 13 is a flowchart illustrating the data development processing in one embodiment of the present invention.

FIG. 13 is a flowchart illustrating a data development processing in this embodiment. These processes are mainly performed by the synchronization processing determination module 1002 and the dot arrangement pattern allocation module 1004 in FIG. 5.

In FIG. 13, 4-bit quantized data (data of nine value of 0 to 8) transferred from the host apparatus 1000 is firstly received. The received data is stored in the reception buffer 1001 (Step S1). Next, Step S2 reads, from the data stored in the reception buffer 1001, 4-bit quantized data for one pixel. Next, Step S3 determines whether or not the read quantized data includes data regarding an ink color requiring a synchronization processing of a dot arrangement pattern (which will be described later). In this embodiment, ink colors requiring the synchronization processing are cyan and magenta. When the quantized data includes the data regarding cyan and magenta inks requiring the synchronization processing as described above, Step S4 determines whether or not the data is at a level requiring the synchronization processing. In this embodiment, the data of small cyan and small magenta corresponding to the tone levels 3 to 7 for printing an half tone region are subjected to the synchronization processing. Although this example subjects only the data of small cyan and small magenta corresponding to the tone levels 3 to 7 to the synchronization processing, all tones of small cyan and small magenta also may be subjected to the synchronization processing.

With regards to the data subjected to the synchronization processing, a synchronization processing (Step S5) (which will be described later) is used to determine a dot arrangement pattern number (NO. 1 or NO. 2) used for the data and Step S6 subsequently selects the pattern corresponding to the determined pattern NO. Then, the selected pattern is developed by the development buffer 1005 (Step S7).

With regards to the data not to be subjected to the synchronization processing on the other hand, Step S6 selects the pattern NO. 1 or NO. 2 as a dot arrangement pattern corresponding to the level of the data. This example identifies, with regards to the data not to be subjected to the synchronization processing, the existence or nonexistence of pixel data in the pixel array to alternately select the two patterns of the same level (NO. 1, NO. 2). Then, the selected pattern is developed by the development buffer 1005 (Step S7). It is noted that, the processing of the data not to be subjected to the synchronization processing is not limited to the alternate selection of the two patterns of the same level (NO. 1, NO. 2). Specifically, the processing also may be, for example, a random selection of these two patterns (NO. 1, NO. 2). Alternatively, when there are three or more patterns of the same level, the processing also may be the one for repeatedly selecting these three or more patterns in a predetermined order (e.g., NO. 1→NO. 2→NO. 3→NO. 1 . . . ).

Thereafter, Step S8 confirms, with regards to all pixels of the image data stored in the reception buffer 1001 in Step S1, whether the development by the development buffer 1004 is completed or not. When some pixels are not yet developed, the processing returns to Step S2. When all pixels are developed, this development processing is completed.

(Synchronization Processing)

FIG. 14 illustrates an example of the synchronization processing (Step S5).

As described above, this embodiment focuses attention on the half tone region in which uneven print density tends to be periodically caused in the main scanning direction and applies the synchronization processing only to the data of the tone level used for the printing of the half tone region. Furthermore, this embodiment also applies the synchronization processing to the data for forming small cyan dots and the data for forming small magenta dots. This embodiment does not apply the synchronization processing to the data for forming large dots because this data is estimated to cause the following two situations when the displacement of ink impact position is caused in the sub scanning direction.

(1) The change of the area factor is small; and (2) Although an interference between dots having different colors is caused, the high density suppresses the interference from being noticeable.

Figure 14A:
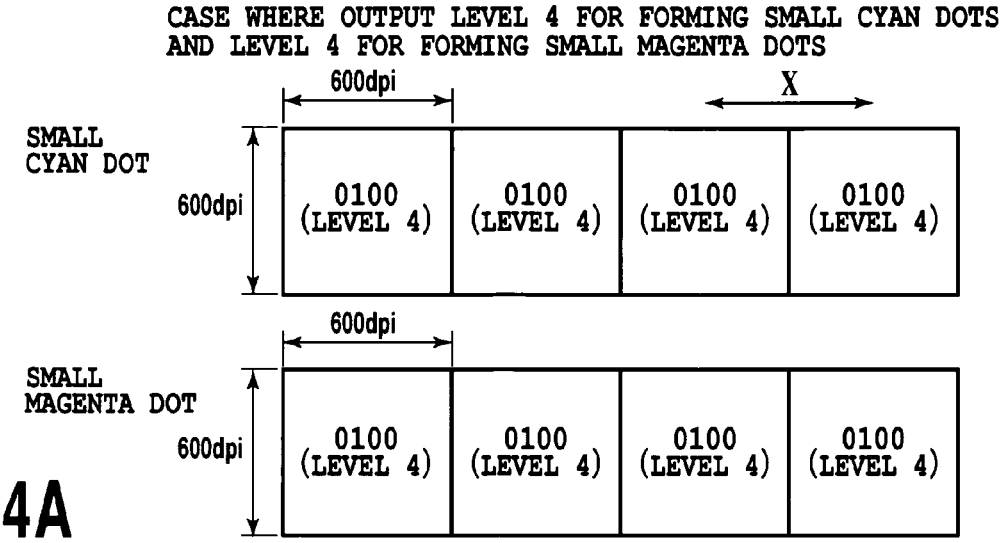
FIG. 14A shows an example of data of an half tone region requiring a synchronization processing in one embodiment of the present invention.

This example assumes, as an example of the data of the half tone region requiring the synchronization processing, a case as in FIG. 14A where both of the data for forming small cyan dots and the data for forming small magenta dots have the level 4 (i.e., the same case as the above-described case of FIG. 8A). However, there may be other cases including, for example, a case for the data for the half tone region requiring the synchronization processing in which the former has the level 4 and the latter has the level 3.

Figure 14B:
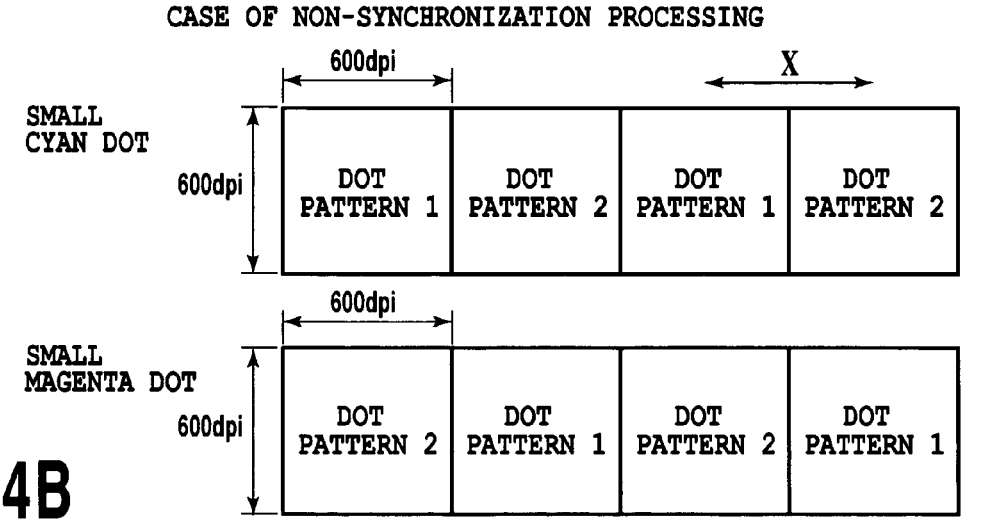
FIG. 14B illustrates a dot pattern when the data of FIG. 14A is not subjected to the synchronization processing.

When these data are not subjected to the synchronization processing, the existence or nonexistence of data for forming small cyan dots and data for forming small magenta dots within a pixel array is merely identified individually as in the case of other data to alternately select, with regards to each data, one of the two patterns (NO. 1, NO. 2) having the same level in an independent manner. In this case, there is a high possibility where the combination of NO. 1 and No. 2 as shown in FIG. 14B is selected as a combination of a pattern for forming small cyan dots and a pattern for forming small magenta dots allocated to the same pixel. This combination of patterns of FIG. 14B corresponds to the above-described dot arrangement of FIG. 8B. In this case, dots are formed within the same pixel by, as described above, the combination of the nozzle arrays SC1 and SM2 in which the distance between nozzles is relatively long and the combination of the nozzle arrays SC2 and SM1 in which the distance between nozzles is relatively long, causing a situation where uneven print density tends to be periodically caused in the main scanning direction.

Figure 14C:
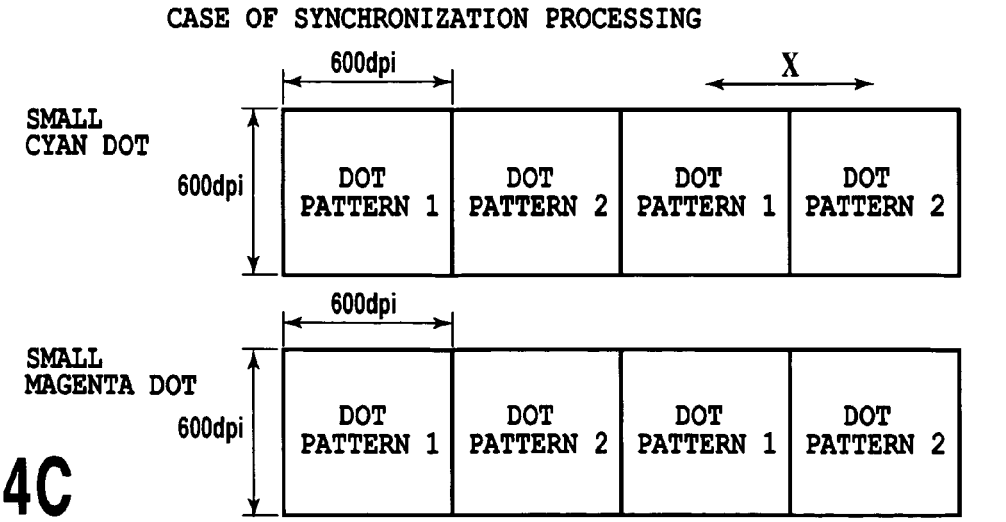
FIG. 14C illustrates a dot pattern when the data of FIG. 14A is subjected to the synchronization processing.

To prevent this, this embodiment determines as described above, when the quantized data for one pixel read from the reception buffer 1001 is the data as shown in FIG. 14A, that the data requires the synchronization processing. Then, by the synchronization processing to the data, the combination as shown in FIG. 14C of a pattern for forming small cyan dots and a pattern for forming small magenta dots that are allocated to the same pixel is determined and the combination of these pattern of NO. 1 and the combination of these pattern of NO. 2 are determined. As a method for determining the combination of patterns, such a method is used that alternately selects, whenever a pixel including small cyan data and small magenta data is generated, the combination of NO. 1 patterns and the combination of NO. 2 patterns.

This combination of patterns of FIG. 14C corresponds to the above-described dot arrangement of FIG. 8C. This causes, as described above, dots to be formed within the same pixel by the combination of the nozzle arrays SC1 and SM1 in which the distance between nozzles is relatively short and the combination of the nozzle arrays SC2 and SM2 in which the distance between nozzles is relatively short. This can reduce the periodic uneven print density in the main scanning direction that tends to be caused in the half tone level. This also can omit the synchronization processing with regards to the data at a level not requiring the synchronization processing.

As described above, in this embodiment, a plurality of image data are n-valued (n=3) with a predetermined resolution so as to correspond to printing elements for a group of a plurality of ink colors and the respective quantized data is independently allocated, for each ink color, to a dot arrangement pattern of L (lateral)×M (longitudinal). In this allocation, with regards to quantized data at a specific level (i.e., quantized data at a predetermined level), a specific pattern is selected from a plurality of different dot arrangement patterns. Then, the data for different ink colors are allocated with a combination of the specific patterns.

The specific pattern is used to specify a nozzle array for printing the same pixel including the data for different ink colors. Specifically, the specific pattern is used to specify a nozzle array in which the distance between nozzles is short so that the nozzle array can be used to print the same pixel for forming dots of different ink colors. When the data for different ink colors has the level 4, the specific pattern allocates the same number of dots to the same raster in the dot arrangement pattern of (L×M) as described above so that dots are unequally distributed to the odd number rasters and the even number rasters.

By allocating the specific pattern as described above, an ink jet printing apparatus for performing a printing with a relatively high resolution can prevent the deterioration of a printed image due to accuracies with which a printing head is attached or a mechanism section is provided. The allocation as described above can suppress the generation of periodic uneven print density in particular that is caused among different ink colors in an half tone region.

The printing head of this embodiment is structured such that a pair of nozzle arrays is provided to each ink color. By distributing data to the pair of nozzle arrays almost equally, the loads on the printing element of the respective nozzle arrays are dispersed. When the printing head as described above is used, there is a risk in which the synchronization processing as described above cannot provide the dispersion of loads to the printing elements. However, this risk causes no practical problem because there will be no situation where data is intensively distributed to a specific nozzle array when considering a factor that this synchronization processing is limited to an half tone level and a factor that an image of an half tone is generally printed with equal levels.

Second Embodiment

In the first embodiment, the combination of No. 1 patterns or the combination of No. 2 patterns is alternately selected whenever a pixel to be subjected to the synchronization processing (a pixel including small cyan data small magenta data) is caused, thereby realizing the synchronization processing of dot arrangement patterns. The second embodiment is different from the first embodiment in the use of a synchronization processing of dot arrangement patterns different from that of the first embodiment. The second embodiment is the same as the first embodiment except for the synchronization processing method of dot arrangement patterns. Thus, the following section will describe only the synchronization processing method of dot arrangement patterns in the second embodiment.

In the second embodiment, pixel positions in the main scanning direction are previously associated with to-be-selected patterns so that a pattern is selected depending on the position of pixel data, thereby realizing the synchronization processing of dot arrangement patterns. Specifically, among a plurality of pixels corresponding to 600 dpi×600 dpi shown in FIG. 14C, a pixel corresponding to an odd number order (e.g., the first, the third, . . . the Nth (N is an odd number) from left) is associated with a NO. 1 pattern for both of small cyan data and small magenta data and, a pixel corresponding to an even number order (e.g., the second, the fourth, . . . the N+1th (N is an odd number) from left) is associated with a NO. 2 pattern for both of small cyan data and small magenta data. When a pixel corresponding to an odd number order is printed, the NO. 1 pattern is used for both of small cyan data and small magenta data. When a pixel corresponding to an even number order is printed, the NO. 2 pattern is used for both of small cyan data and small magenta data.

When the system as described above prints an odd numbered pixel including small cyan data and small magenta data, the combination of NO. 1 patterns is always used. Thus, the odd numbered pixel can be printed by the combination of nozzle arrays SC2 and SM2 in which the distance between nozzle arrays in main scanning direction is relatively short. Similarly, when an even numbered pixel including small cyan data and small magenta data is printed, the combination of NO. 2 patterns is always used. Thus, the even numbered pixel can be printed by the combination of nozzle arrays SC1 and SM1 in which the distance between nozzle arrays in main scanning direction is relatively short. By the manner as described above, this example subjects all pixels consisting of odd numbered pixels and even numbered pixels to the synchronization processing of dot arrangement patterns with regards to small cyan data and small magenta data.

Even in the case of a pixel in which small cyan and small magenta do not coexist (i.e., a pixel not requiring the synchronization processing), the system as described above selects a pattern depending on the position of the pixel as in the case of a pixel requiring the synchronization processing (a pixel in which small cyan and small magenta coexist). Thus, this system does not require the determination with regards to whether a pixel requires the synchronization processing or not.

In this example, an ink type for which a pattern is selected depending on a pixel position may be at least small cyan and small magenta to be subjected to the synchronization processing. With regards to the other ink types (cyan, magenta, yellow, black), any pattern may be selected. Specifically, the NO. 1 pattern or the NO. 2 pattern may be selected randomly or alternately whenever pixel data is caused. Alternatively, as in the case of small cyan and small magenta to be subjected to the synchronization processing, a selected pattern may be fixed depending on a pixel position.

As described above, this embodiment subjects dot arrangement patterns to the synchronization processing so that the combination of nozzle arrays in which the distance between nozzle arrays in the main scanning direction is short (SC1 and SM1, SM2 and SM2) can provide a printing of the same pixel. This can reduce the uneven print density that is periodically caused in the main scanning direction.

Third Embodiment

The first and second embodiments described an example of the synchronization processing in which the combination of No. 1 patterns or the combination of No. 2 patterns is used for a printing of the same pixel. However, the present invention is not limited to this.

As described above with reference to FIG. 12, the present invention is characterized in that a dot arrangement pattern is selected so that the combination of nozzle arrays in which the distance between nozzle arrays in the main scanning direction is short can provide a printing of the same pixel. In the first and second embodiments, the arrangement of ejection openings as shown in FIG. 3 allows the combination of NO. 1 patterns or the combination of NO. 2 patterns to be applicable to the synchronization processing.

However, depending on an ejection opening arrangement, there may be a case in which the combination of a pattern NO. 1 of small cyan and a pattern No. 2 of small magenta or the combination of a pattern NO. 2 of small cyan and a pattern No. 1 of small magenta is applicable to the synchronization processing. For example, a case will be considered in which the ejection opening of SM1 is an ejection opening corresponding to an odd number raster and the ejection opening of SM2 is an ejection opening corresponding to an even number raster. In this case, in order to print the same pixel by the combination of the nozzle arrays SC1 and SM1 in which the distance between nozzle arrays in the main scanning direction is relatively short, it is required to use the combination of the pattern NO. 2 of small cyan and the pattern NO. 1 of small magenta. In order to print the same pixel by the combination of the nozzle arrays SC2 and SM2 in which the distance between nozzle arrays in the main scanning direction is relatively short, it is required to use the combination of the pattern NO. 1 of small cyan and the pattern NO. 2 of small magenta.

Thus, in the case where ejection openings are arranged so that the ejection opening of SM1 corresponds to an odd number raster and the ejection opening of SM2 corresponds to an even number raster, the synchronization processing is performed so that the printing of the same pixel is performed by the combination of the pattern NO. 1 of small cyan and the pattern NO. 2 of small magenta or the combination of the pattern NO. 2 of small cyan and the pattern NO. 1 of small magenta.

Other Embodiments

Although the above-described first to third embodiments subjected small cyan and small magenta to the synchronization processing of dot arrangement patterns, the present invention is not limited to this. For example, even when density regions using large cyan and large magenta include uneven print densities that are noticeable in a periodic manner, these large cyan and large magenta also may be subjected to the synchronization processing.

Although the above-described first to third embodiments used inks of small cyan, large cyan, small magenta, large magenta, yellow, and black, combinations of inks to which the present invention is applicable are not limited to them. For example, there may be a combination at least including inks of cyan, light cyan (cyan ink having a lower color material concentration than that of cyan ink), magenta, light magenta (magenta ink having a lower color material concentration than that of magenta ink), yellow, and black. In the case of this embodiment, light cyan ink and light magenta ink are preferably subjected to the synchronization processing of dot arrangement patterns.

Although the above-described first to third embodiments limited the combinations subjected to the synchronization processing to the combination of cyan and magenta, other combinations of colors (e.g., combination of red ink and cyan ink, combination of red ink and magenta ink) also may be subjected to the synchronization processing.

Combinations to be subjected to the synchronization processing are not limited to the combinations of different colors and also may be the combinations of similar colors. For example, the combination of cyan (C) and small cyan (SC) or the combination of cyan (C) and light cyan (LC) also may be subjected to the synchronization processing. When there are four or more nozzle arrays for ink of the same color, it means that there are a plurality of combinations of nozzle arrays for the ink of the same color. In this case, the combination of nozzle arrays for the ink of the same color also may be subjected to the synchronization processing.

Alternatively, the synchronization processing for the above-described combination of different colors and the synchronization processing for the above-described combination of the same or similar color(s) may coexist.

The present invention also may be applied to a system composed of a plurality of machines (e.g., host computer, interface machine, reader, printer). Alternatively, the present invention also may be applied to an apparatus consisting of one machine (e.g., copier, facsimile apparatus).

The objective of the present invention is also achieved by supplying a storage medium in which program codes of software for realizing the functions of the above-described embodiments are stored to a system or an apparatus so that a computer of the system or the apparatus (or CPU or MPU) reads the program codes stored in the storage medium to execute the program codes. In this case, the program codes themselves read from the storage medium realize the functions of the above-described embodiments and the storage medium storing the program codes constitutes the present invention.

The storage medium for supplying the program codes may be, for example, a floppy disk, a hard disk, an optical disk, a magnetooptical disk, CD-ROM, CD-R, a magnetic tape, nonvolatile memory card, or ROM.

The functions of the above-described embodiments also can be realized by a method other than those for executing program codes read by a computer. For example, the functions of the above-described embodiments also can be realized by a method in which, based on the instructions according to the program codes, an operating system (OS) or the like running on a computer executes an actual processing partially or entirely.

Alternatively, the functions of the above-described embodiments also can be realized by a method in which the program codes read from the storage medium are written into a memory included in a function enhancement board inserted to the computer or a function enhancement unit connected to the computer so that CPU or the like included in the function enhancement board or in the function enhancement unit executes, based on the instructions according to the program codes, an actual processing partially or entirely.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-238888 filed Aug. 18, 2004, which is hereby incorporated by reference herein.

What is claimed is:

1. An ink jet printing apparatus configured to form ink dots to a pixel of a printing medium by using a printing head while scanning the printing head in a main scanning direction, the printing head including at least first, second, third, and fourth nozzle arrays, the first and second nozzle arrays configured to form first ink dots, the third and fourth nozzle arrays configured to form second ink dots different from the first ink dots in at least the color or size, an interval between the first nozzle array and third nozzle array in the main scanning direction being shorter than an interval between the first nozzle away and fourth nozzle away in the main scanning direction, an interval between the second nozzle away and fourth nozzle array in the main scanning direction being shorter than an interval between the second nozzle away and third nozzle away in the main scanning direction, said apparatus comprising:

a controller that causes the printing head to form the first and second ink dots to a certain pixel to which a predetermined number more than one of the first ink dots and a predetermined number more than one of the second ink dots are to be formed, wherein the first and second ink dots are formed to the certain pixel by selectively using a combination of the first and third nozzle arrays or a combination of the second and fourth nozzle arrays without using a combination of the first and fourth nozzle arrays and a combination of the second and third nozzle arrays, whereby when the combination of the first and third nozzle arrays is used to form the first and second ink dots to the certain pixel, then the combination of the second and fourth nozzle arrays is not used to form the first and second dots to the certain pixel and when the combination of the second and fourth nozzle arrays is used to form the first and second ink dots to the certain pixel, then the combination of the first and third nozzle arrays is not used to form the first and second dots to the certain pixel.

2. The ink jet printing apparatus according to claim 1, wherein the number of first ink dots and the number of second ink dots are the same number.

3. An ink jet printing method for forming ink dots to a pixel of a printing medium comprising the steps of:

scanning a printing head in a main scanning direction, the printing head including at least first, second, third, and fourth nozzle arrays, the first and second nozzle arrays configured to form first ink dots, the third and fourth nozzle arrays being able to form second ink dots different from the first ink dots in at least the color or size, an interval between the first nozzle array and third nozzle array in the main scanning direction being shorter than an interval between the first nozzle array and fourth nozzle array in the main scanning direction, an interval between the second nozzle array and fourth nozzle array in the main scanning direction being shorter than an interval between the second nozzle array and third nozzle array in the main scanning direction; and forming the first and second ink dots by using the printing head to a certain pixel to which a predetermined number more than one of the first ink dots and a predetermined number more than one of the second ink dots are to be formed, wherein the first and second ink dots are formed to the certain pixel by selectively using a combination of the first and third nozzle arrays or a combination of the second and fourth nozzle arrays without using a combination of the first and fourth nozzle arrays and a combination of the second and third nozzle arrays, whereby when the combination of the first and third nozzle arrays is used to form the first and second ink dots to the certain pixel, then the combination of the second and fourth nozzle arrays is not used to form the first and second dots to the certain pixel and when the combination of the second and fourth nozzle arrays is used to form the first and second ink dots to the certain pixel, then the combination of the first and third nozzle arrays is not used to form the first and second dots to the certain pixel.

* * * * *